US009370931B2

(12) United States Patent
Takagiwa

(10) Patent No.: US 9,370,931 B2
(45) Date of Patent: Jun. 21, 2016

(54) LIQUID STORAGE BODY

(71) Applicant: BROTHER KOGYO KABUSHIKI KAISHA, Nagoya-shi, Aichi (JP)

(72) Inventor: Yutaka Takagiwa, Kariya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 0 days.

(21) Appl. No.: 14/638,850

(22) Filed: Mar. 4, 2015

(65) Prior Publication Data

US 2015/0273845 A1 Oct. 1, 2015

(30) Foreign Application Priority Data

Mar. 31, 2014 (JP) ..... 2014-074600
Jan. 23, 2015 (JP) ..... 2015-010797

(51) Int. Cl.
*B41J 2/175* (2006.01)

(52) U.S. Cl.
CPC .... *B41J 2/17513* (2013.01); *B41J 2002/17516* (2013.01)

(58) Field of Classification Search
CPC ..... B41J 2/17516; B41J 2/17533; B41J 2/17586; B41J 2/17513; B41J 2002/17516; B41J 2002/17586; B65D 75/5883
USPC ..... 347/85, 86
See application file for complete search history.

(56) References Cited

U.S. PATENT DOCUMENTS 5,691,755 A * 11/1997 Pawlowski et al. ..... 347/86
5,950,403 A 9/1999 Yamaguchi et al.
6,220,702 B1 * 4/2001 Nakamura et al. ..... 347/86
6,224,199 B1 5/2001 Yamaguchi et al.
6,264,314 B1 * 7/2001 Mochizuki et al. ..... 347/86
6,289,654 B1 9/2001 Yamaguchi et al.
6,505,924 B2 * 1/2003 Shimizu ..... 347/86
6,582,068 B2 * 6/2003 Ishizawa et al. ..... 347/85
6,609,789 B1 * 8/2003 Hunt ..... 347/86
7,293,863 B2 * 11/2007 Seino et al. ..... 347/85
8,083,334 B2 * 12/2011 Nozawa ..... 347/86
2001/0013885 A1 8/2001 Yamaguchi et al.

(Continued)

FOREIGN PATENT DOCUMENTS

CN 1193570 A 9/1998
CN 1579783 A 2/2005
CN 102640061 A 8/2012

(Continued)

OTHER PUBLICATIONS

Chinese Office Action issued on Feb. 1, 2016 in the Chinese Patent Application No. 201510126495.7 corresponding to the present application.

*Primary Examiner* — Anh T. N. Vo

(74) *Attorney, Agent, or Firm* — Fox Rothschild LLP

(57) ABSTRACT

The liquid storage body is provided with a liquid storage bag and a plug. The liquid storage bag is formed of two layers of a sheet. The plug is connected to a first end portion of the liquid storage bag. The liquid storage bag is provided with a liquid storage portion and an extension portion. The liquid storage portion stores the liquid. The extension portion is connected to the liquid storage portion at a second end portion and extends in an extending direction. The extension portion does not store the liquid. A length of the extension portion in the extending direction is longer than a length of edge portions in an orthogonal direction.

12 Claims, 25 Drawing Sheets

(56) References Cited

U.S. PATENT DOCUMENTS

| | | | |
|---|---|---|---|
| 2005/0057625 | A1 | 3/2005 | Ishizawa et al. |
| 2013/0038667 | A1 | 2/2013 | Bachar et al. |

FOREIGN PATENT DOCUMENTS

| | | | |
|---|---|---|---|
| JP | 2002-361882 | A | 12/2002 |
| JP | 3781104 | B2 | 5/2006 |

* cited by examiner 641
32
64
645
60
62
43
434
433
432
431
61
644
642
45
334
352
335
34
33
521
523
522
52
344
451
451
351
364
37
51
512
511
513
363
345
362
341
361
UP
(FACING DIRECTION)
REAR
RIGHT
(SECOND DIRECTION)
LEFT
FRONT
(ORTHOGONAL DIRECTION)
(FIRST DIRECTION)
DOWN

LIQUID STORAGE BODY

CROSS-REFERENCE TO RELATED APPLICATION

This application claims priority to Japanese Patent Application No. 2014-074600 filed on Mar. 31, 2014 and Japanese Patent Application No. 2015-010797 filed on Jan. 23, 2015, the disclosures of which are herein incorporated by reference in their entirety.

BACKGROUND

The present disclosure relates to a liquid storage body.

In related art, a liquid storage body is known in which a plug is connected to a bag that stores a liquid. For example, an ink container of the related art is provided with an ink storage portion to which an ink supply opening is attached. An urging member is mounted on a surface of the ink storage portion. The urging member generates a restoring force in a direction to which the ink supply opening is located. When the ink storage portion is fully filled with ink, the urging member is extended by gravity of ink, against the restoring force of the urging member. On the contrary, when the amount of ink in the ink storage portion decreases by consumption of ink and the restoring force becomes larger than gravity of ink, then the urging member takes up the ink storage portion. By the urging member taking up the ink storage portion, ink remaining in the ink storage portion is gathered toward the ink supply opening and the ink emerges to the outside of the ink storage portion.

SUMMARY

As an alternative to the urging member taking up the ink storage portion, for example, it is conceivable that an operator may manually take up the ink storage portion toward the ink supply opening, and thus cause the ink to be discharged from the ink supply opening. However, as a portion of the ink storage portion at which the taking up of the ink storage portion is started contains ink, it is easy for ink to remain in the portion of the ink storage portion at which the taking up is started. As the ink storage portion that has been taken up contains ink, a diameter of the taken up ink storage portion becomes large. When the diameter of the taken up ink storage portion becomes large, an extra space in which wrinkles and creases may be caused is easily generated. In this case, there is a possibility of remaining liquid in the wrinkles and creases of the ink storage portion.

Various exemplary embodiments of the general principles described herein provide an ink storage portion in which liquid residue is hardly to be caused when a bag storing liquid is taken up.

A liquid storage body of an embodiment having a bag formed of two layers of flexible sheets and a hollow plug connected to the bag, the liquid storage body comprising: a first end portion which is an end portion of the bag in an axial direction of the plug, the first end portion being connected to the plug; a second end portion which is an end portion of the bag in the axial direction, the second end portion being provided on an opposite side from the first end portion; a pair of edge portions each of which is provided on each end portion of the bag in an orthogonal direction by bonding the two layers of the sheets, the orthogonal direction being a direction that is parallel to a surface of the sheet and is orthogonal to an extending direction, the extending direction being a direction from the first end portion to a second end portion of the bag;

a liquid storage portion having an enclosed space in which liquid can be stored, the liquid storage portion being connected to the plug at the first end portion; and an extension portion which is a portion that does not store the liquid and which is connected to an extending direction side of the liquid storage portion, the extension portion having a length in the extending direction longer than a length in the orthogonal direction of the edge portion.

BRIEF DESCRIPTION OF THE DRAWINGS

Embodiments will be described below in detail with reference to the accompanying drawings in which.

DETAILED DESCRIPTION

Figure 1:
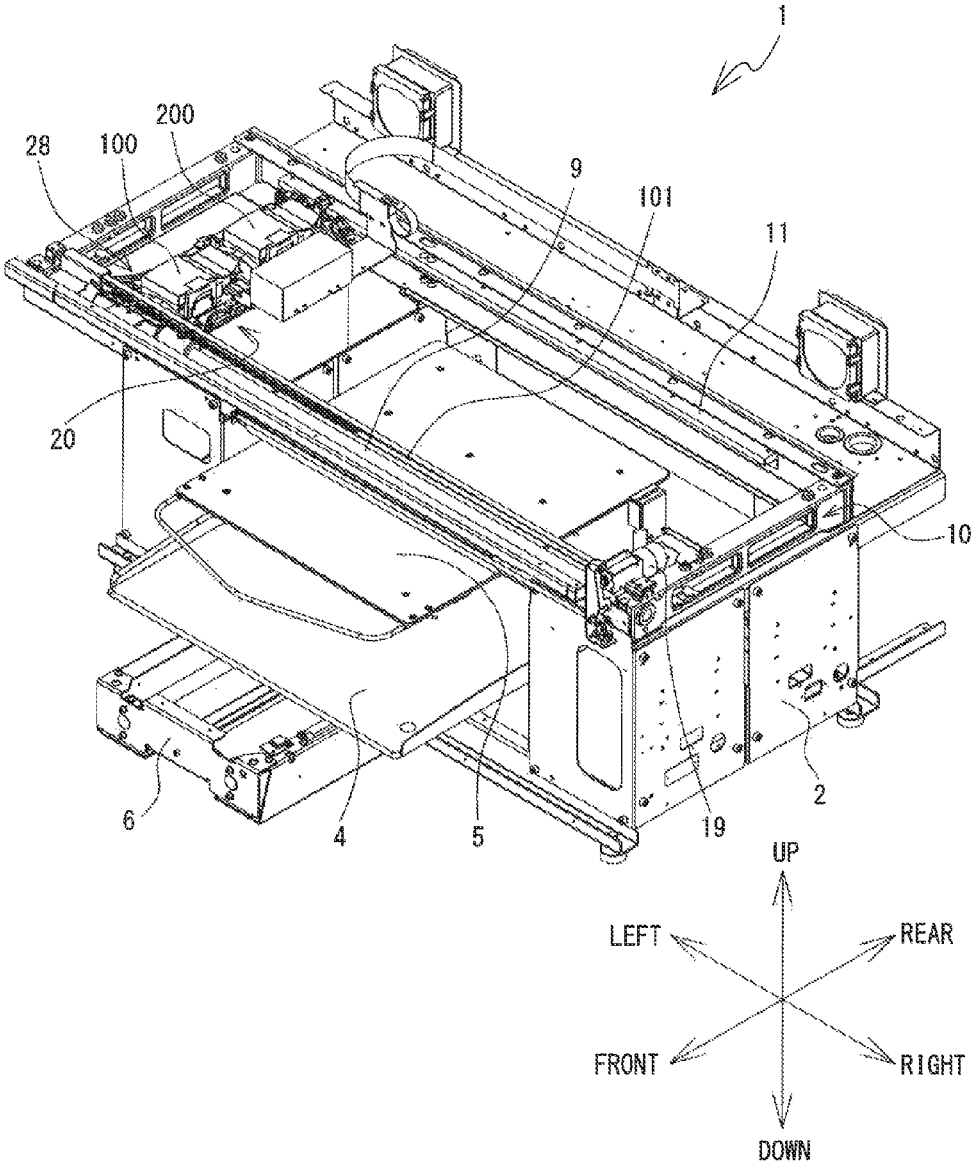
FIG. 1 is a perspective view of a printer.
Figure 2:
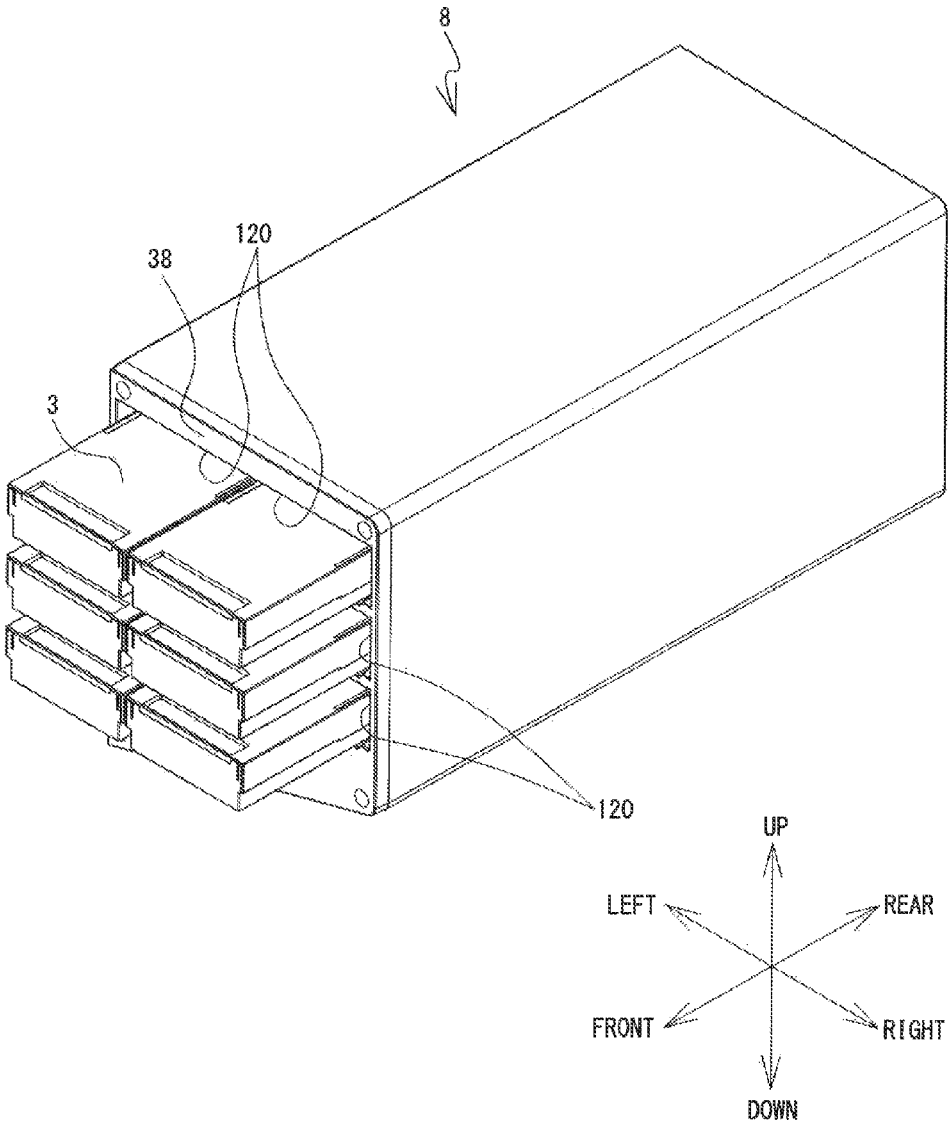
FIG. 2 is a perspective view of a cartridge mounting portion.

An up-down direction, a left-right direction and a front-rear direction indicated by arrows in FIG. 1 respectively denote an up-down direction, a left-right direction and a front-rear direction of a printer 1. Arrows in FIG. 2 are the same.

As shown in FIG. 1, the printer 1 is an inkjet printer. The printer 1 discharges a liquid ink onto a print medium (not shown in the drawings). In the present embodiment, the print medium is a fabric, such as a T-shirt or the like. The print medium may be paper or the like. The printer 1 of the present embodiment can discharge five types of ink in a downward direction. The printer 1 can perform color printing on a fabric. The five types of ink are white (W), black (K), yellow (Y), cyan (C) and magenta (M).

The printer 1 is mainly provided with a housing 2, a platen drive mechanism 6, a platen 5, a tray 4, a frame body 10, a guide shaft 9, a rail 11, a carriage 20, a support portion (not shown in the drawings), head units 100 and 200, a drive belt 101 and a drive motor 19.

The housing 2 is a substantially cuboid shape that extends in the left-right direction. An operating portion (not shown in the drawings) is provided on a right front portion of the housing 2. The operating portion is provided with a display and operating buttons. The display displays various types of information. A user operates the operating buttons when inputting commands relating to various operations of the printer 1.

A pair of guide rails (not shown in the drawings) are provided inside the platen drive mechanism 6. The pair of guide rails extend in the front-rear direction. The pair of guide rails support the platen 5 and the tray 4. The platen 5 and the tray 4 can move along the pair of guide rails. A driving source of the platen drive mechanism 6 is a motor (not shown in the drawings). The motor is positioned on a rear end portion of the platen drive mechanism 6. The platen 5 and the tray 4 move along the pair of guide rails due to a driving force of the motor. The platen 5 is a substantially rectangular shaped plate that extends in the front-rear direction. The platen 5 is positioned below the frame body 10. The fabric is placed on an upper surface of the platen 5. The tray 4 is a rectangular shape. The tray 4 is positioned below the platen 5. When the user places a T-shirt on the platen 5, the tray 4 holds the sleeves of the T-shirt. Thus, the sleeves do not fall inside the housing 2.

The frame body 10 is a substantially rectangular shaped frame. The frame body 10 is positioned above the housing 2. The guide shaft 9 and the rail 11 are provided inside the frame body 10. The frame body 10 supports the guide shaft 9 and the rail 11. The guide shaft 9 is a shaft member that extends in the left-right direction. The rail 11 is a rod-shaped member that extends in the left-right direction. The rail 11 faces the guide shaft 9. The guide shaft 9 and the rail 11 are mutually separated in the front-rear direction.

The guide shaft 9 and the rail 11 support the carriage 20. The carriage 20 can move in the left-right direction. The head units 100 and 200 are mounted on the carriage 20. Bottom surfaces of each of the head units 100 and 200 have head portions (not shown in the drawings). The head portions are provided with a plurality of fine nozzles. The head portions discharge droplets of ink in a downward direction from the nozzles as a result of operation of a piezoelectric element.

The flexible drive belt 101 is a belt shape that is stretched along the inside of the frame body 10 in the left-right direction. The drive belt 101 is made of synthetic resin. The drive motor 19 is positioned inside the frame body 10 and to the front right side. The drive motor 19 is positioned between the guide shaft 9 and the rail 11 in the front-rear direction. The drive motor 19, which is able to rotate in the positive and reverse directions, is coupled to the carriage 20 via the drive belt 101. An overview of a printing operation by the printer 1 on the fabric is as follows. When the drive motor 19 drives the drive belt 101, the carriage 20 reciprocates in the left-right direction and the head portions of the head units 100 and 200 thus reciprocate in the left-right direction. The platen 5 feeds the fabric in the front-rear direction. The feed direction of the fabric by the platen 5 is the front-rear direction. The ink is discharged by the head portions that are reciprocating in the left-right direction.

Figure 3:
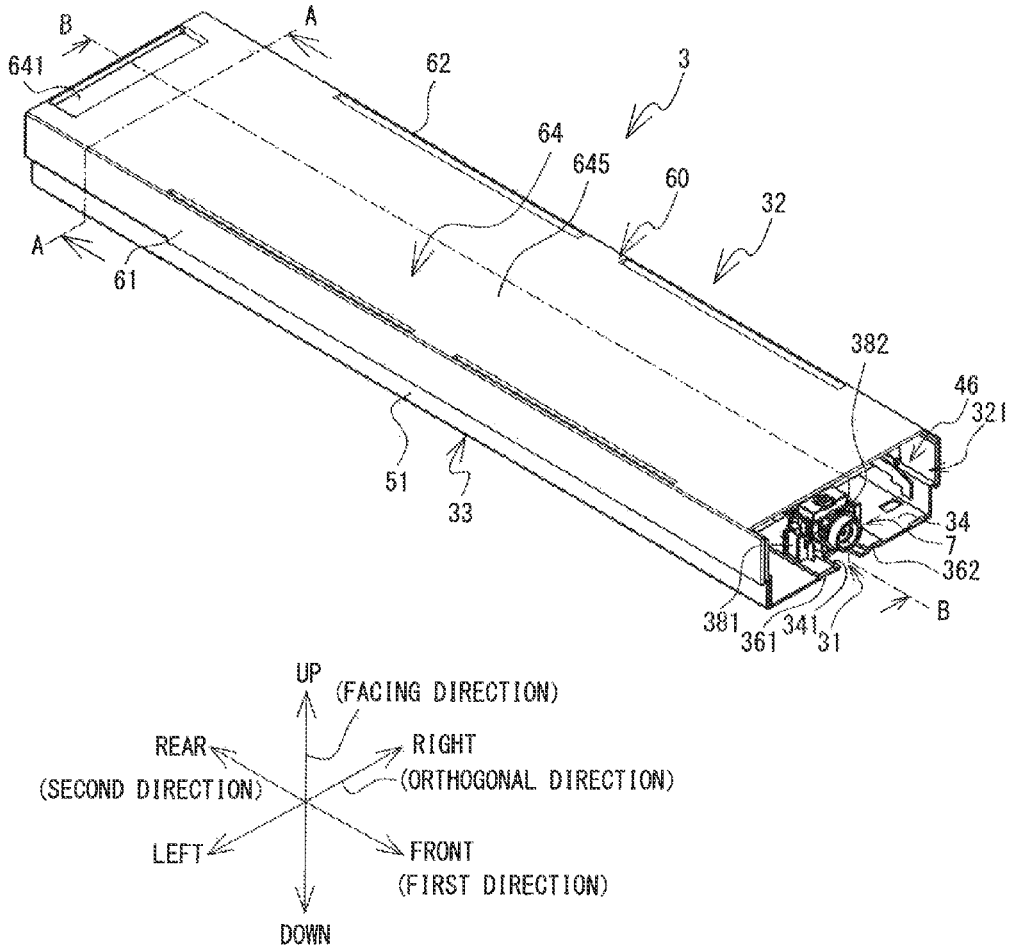
FIG. 3 is a perspective view of a cartridge.

The cartridge mounting portion 8 shown in FIG. 2 is adjacent to the housing 2, on the outside and to the right of the housing 2. A plurality of cartridges 3 (six in the present embodiment) can be mounted in the cartridge mounting portion 8. The cartridges 3 that are mounted in the cartridge mounting portion 8 supply ink to the head portions of the head units 100 and 200. A frame portion 38 on a front portion of the cartridge mounting portion 8 has a plurality of open portions 120. The cartridge 3 can be inserted into and removed from the open portion 120. The frame portion 38 has three columns of the open portions 120 in the up-down direction and two rows of the open portions 120 in the left-right direction. As shown in FIG. 3, the cartridge 3 houses a liquid storage body 31. The liquid storage body 31 has a plug 7. The plug 7 has a rubber plug (not shown in the drawings). When the cartridge 3 is mounted in the cartridge mounting portion 8, a hollow needle (not shown in the drawings) that leads out the liquid from the liquid storage body 31 pierces the rubber plug (not shown in the drawings).

Figure 4:
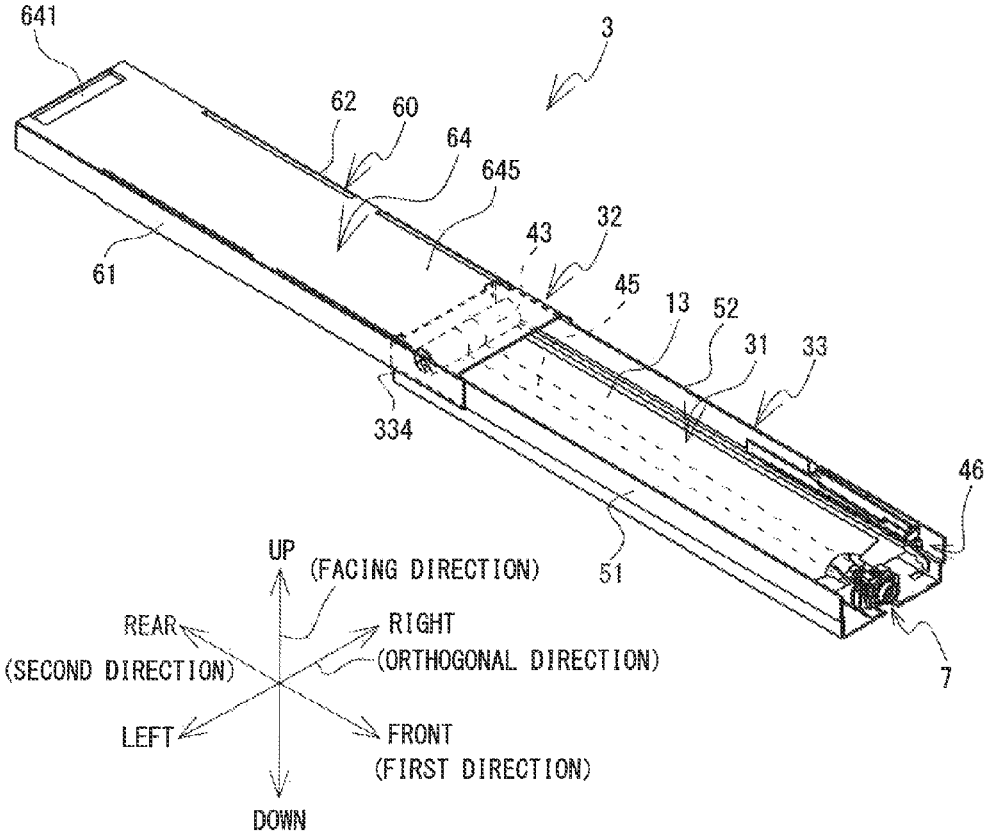
FIG. 4 is a perspective view of the cartridge.

The cartridge 3 will be explained in detail with reference to FIG. 3 to FIG. 16D. In the following explanation, the up-down direction, the left-right direction and the front-rear direction indicated by arrows shown in FIG. 3 respectively denote the up-down direction, the left-right direction and the front-rear direction of the cartridge 3. For ease of explanation, the left-right direction and the front-rear direction of the cartridge 3 shown in FIG. 3 are changed from those of the printer 1 shown in FIG. 2. The direction indicating arrows in FIG. 4 are the same as those shown in FIG. 3. The direction indicating arrows shown in FIG. 5 onward are adjusted such that they match the arrows shown in FIG. 3. As shown in FIG. 3 and FIG. 4, the cartridge 3 is provided with the liquid storage body 31 and a case 32. The case 32 houses the liquid storage body 31.

Figure 5:
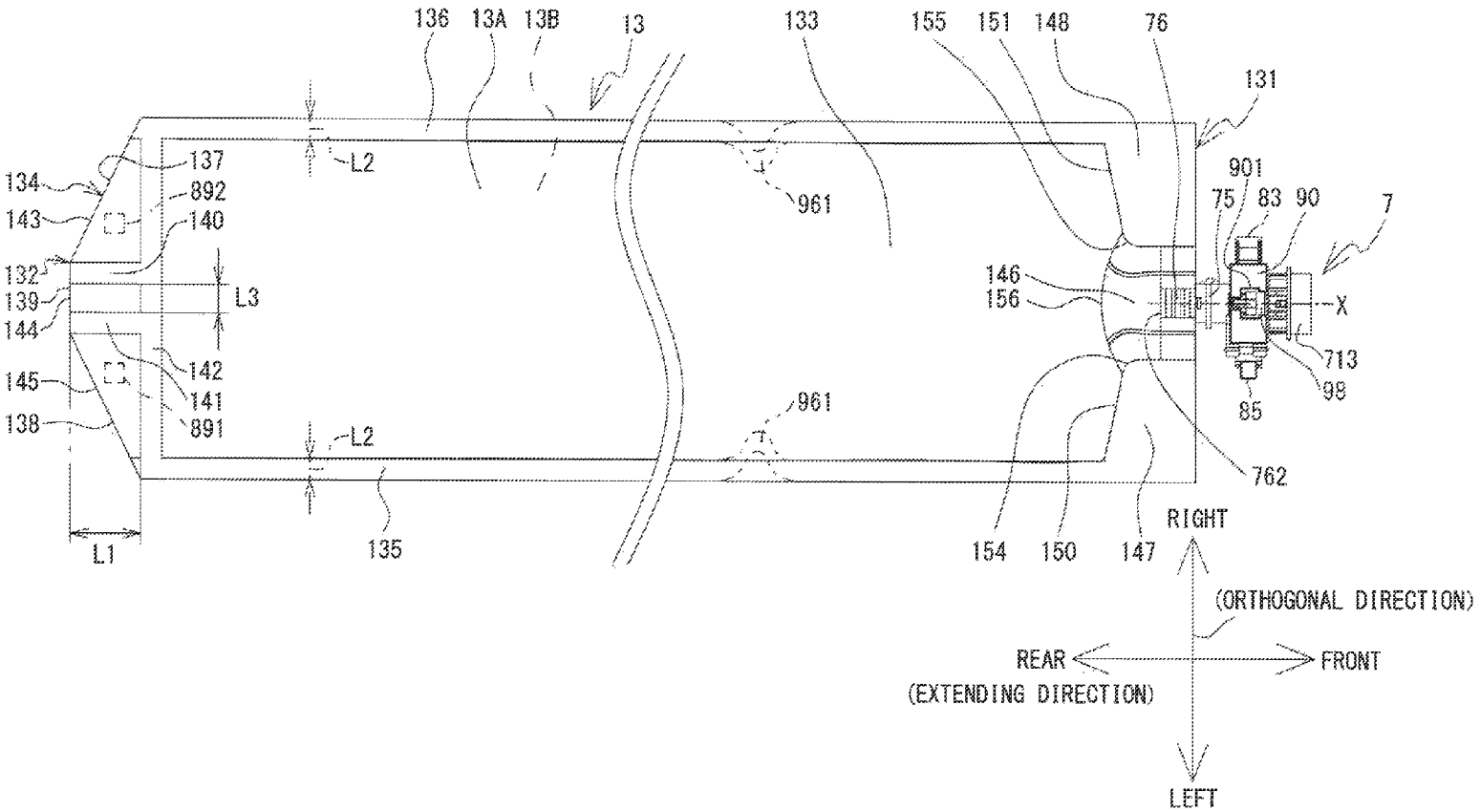
FIG. 5 is a plan view of a liquid storage body.
Figure 6:
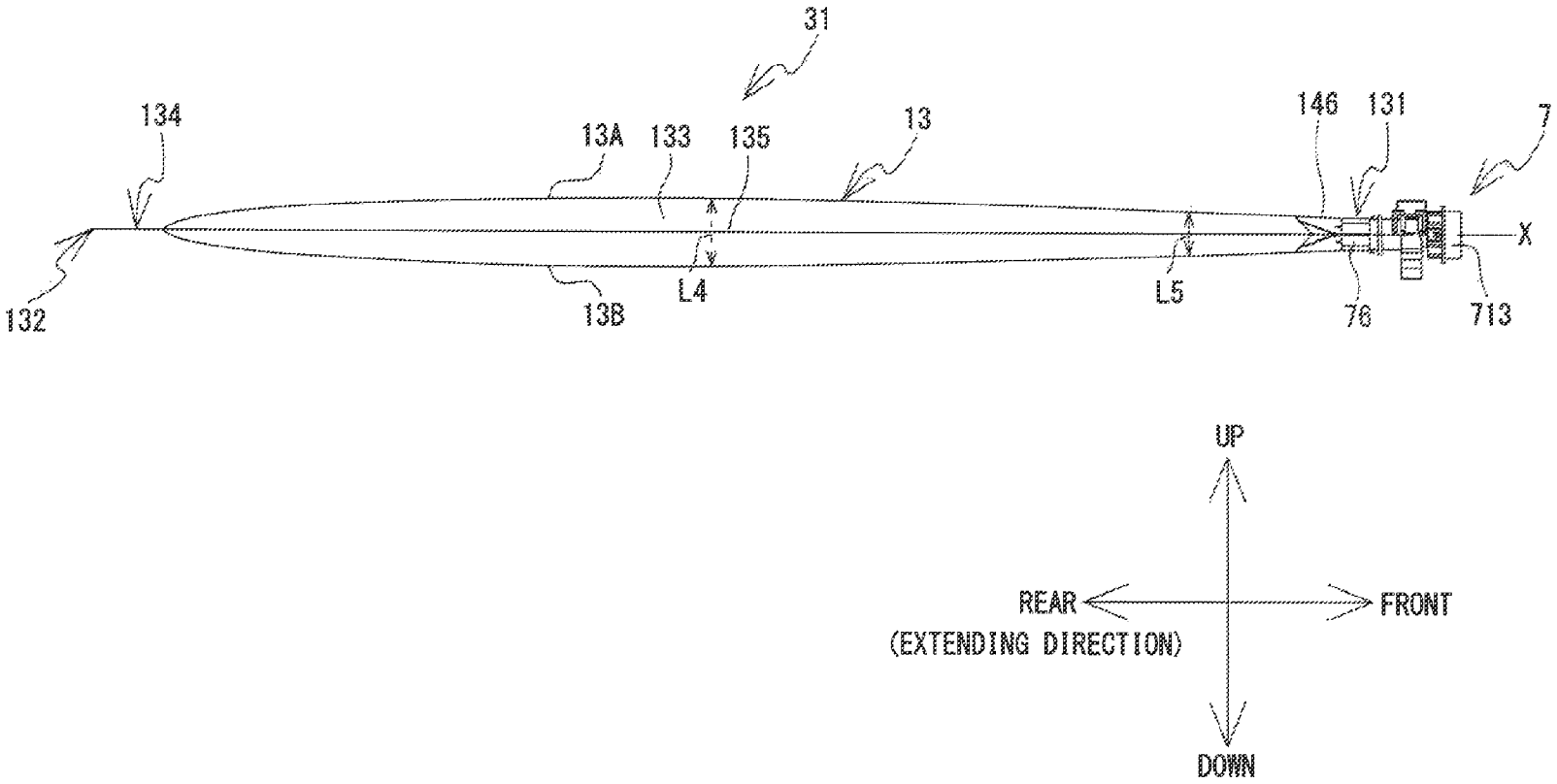
FIG. 6 is a left side view of the liquid storage body.

As shown in FIG. 4 and FIG. 5, the liquid storage body 31 is provided with a liquid storage bag 13 and the plug 7. As shown in FIG. 5 and FIG. 6, the liquid storage bag 13 is a bag shaped container. The liquid storage bag 13 is provided with two flexible sheets 13A and 13B that are made of synthetic resin and that have a rectangular shape. The sheets 13A and 13B are overlapped with each other and are connected by their edge portions being thermally welded. The liquid storage bag 13 extends in the front-rear direction. In the following explanation, the front end portion of the liquid storage bag 13 is referred to a first end portion 131 and the rear end portion of the liquid storage bag 13 that is opposite to the first end portion 131 is referred to as a second end portion 132. The rearward direction from the first end portion 131 toward the second end portion 132 is also referred to as an "extending direction." A surface of the sheet 13A or 13B is also referred to as a "sheet surface." The left-right direction that is orthogonal to the extending direction and is generally parallel to the sheet surface of the liquid storage bag 13 in which liquid is not stored is also referred to as an "orthogonal direction."

The liquid storage bag 13 will be explained in detail. As shown in FIG. 5, the liquid storage bag 13 is provided with a liquid storage portion 133 and an extension portion 134. The liquid storage portion 133 includes the first end portion 131 and extends toward the rear, which is the extending direction. The liquid storage portion 133 internally stores a liquid. Examples of the liquid include ink and a discharging agent. The discharging agent removes color from dyed fabric. The liquid of the present embodiment is ink.

The extension portion 134 is a portion which does not store the ink. The extension portion 134 is connected to the liquid storage portion 133 on the side of the second end portion 132. The extension portion 134 extends from the liquid storage portion 133 in the extending direction. At end portions of the liquid storage portion 133 in the orthogonal direction, portions of the two sheets 13A and 13B that are connected to each other by the thermal welding are referred to as edge portions 135 and 136. At an end portion of the liquid storage portion 133 in the extending direction, a portion of the two sheets 13A and 13B that are connected to each other by the thermal welding in the orthogonal direction is referred to as a rear edge portion 142. The edge portions 135 and 136 extend as far as the extension portion 134. A length L1 of the extension portion 134 in the extending direction is longer than a length L2 of the edge portions 135 and 136 in the orthogonal direction.

The extension portion 134 is provided with tapered portions 137 and 138, first connected portions 140 and 141 and open portions 143, 144 and 145. The tapered portions 137 and 138 are portions that shorten the length of the extension portion 134 in the orthogonal direction such that the extension portion 134 tapers toward the extending direction. An end edge of the extension portion 134 in the extending direction is parallel to the orthogonal direction. The end edge is positioned in a central portion of the extension portion 134 in the orthogonal direction. Therefore, the end edge is hereinafter referred to as a "central portion 139."

The first connected portions 140 and 141 are portions of the extension portion 134 at which the two sheets 13A and 13B are thermally welded to each other. The first connected portions 140 and 141 are positioned further to the inside, in the orthogonal direction, than the edge portions 135 and 136. The first connected portion 140 extends in the extending direction from the rear edge portion 142 and reaches a right end portion of the central portion 139. The first connected portion 141 extends in the extending direction from the rear edge portion 142 and reaches a left end portion of the central portion 139. An inner position from both the edge portion 135 and the edge portion 136 is included in a rear-side area from a rear end of the edge portions 135 and 136 and a front-side area from a front end of the edge portions 135 and 136. The length of the extension portion 134 in the extending direction is referred to as the length L1. An interval in the orthogonal direction between the first connected portions 140 and 141 is referred to as a length L3. L3 is smaller than L1.

The open portions 143, 144 and 145 are provided on an end portion on the extending direction side of the extension portion 134. The open portions 143, 144 and 145 are provided between the sheets 13A and 13B. The open portions 143, 144 and 145 are portions on the end portion on the extending direction side of the extension portion 134 at which the sheets 13A and 13B are not thermally welded to each other. The open portion 143 is provided in the tapered portion 137. The open portion 144 is provided in the central portion 139 and is positioned between the first connected portion 140 and the first connected portion 141. The open portion 145 is provided in the tapered portion 138.

An insertion portion 76 of the plug 7 is provided between the sheets 13A and 13B at the first end portion 131. A curved area 146 is provided in the first end portion 131. In the curved area 146, the sheets 13A and 13B are curved in a direction to separate from each other (in the up-down direction) along the insertion portion 76. The curved area 146 extends further in the extending direction than the insertion portion 76.

Second connected portions 147 and 148, at which the sheets 13A and 13B are thermally welded to each other, are provided in the first end portion 131. The second connected portions 147 and 148 are positioned further to the outside, in the orthogonal direction, than the insertion portion 76. In other words, the insertion portion 76 is provided between the second connected portions 147 and 148 in the orthogonal direction. The second connected portions 147 and 148 have a substantially rectangular shape. The second connected portions 147 and 148 are provided, respectively, with corner portions 154 and 155. The corner portions 154 and 155 are positioned on the inside, in the orthogonal direction, of the edge portions 135 and 136 of the liquid storage bag 13 and further to the rear side with respect to the extending direction than the insertion portion 76. The corner portions 154 and 155 are rounded. In the extending direction, the corner portions 154 and 155 are positioned between an end portion 762 of the insertion portion 76 and an end portion 156 of the curved area 146. End edges of the second connected portions 147 and 148 on the extending direction side are referred to as an end edge 150 and an end edge 151, respectively. The end edge 150 is inclined such that the further the end edge 150 is separated from the end edge 151 in the orthogonal direction, the further to the extending direction side the end edge 150 is positioned. The same also applies to the end edge 151. The end edge is also referred as a side.

Figure 7:
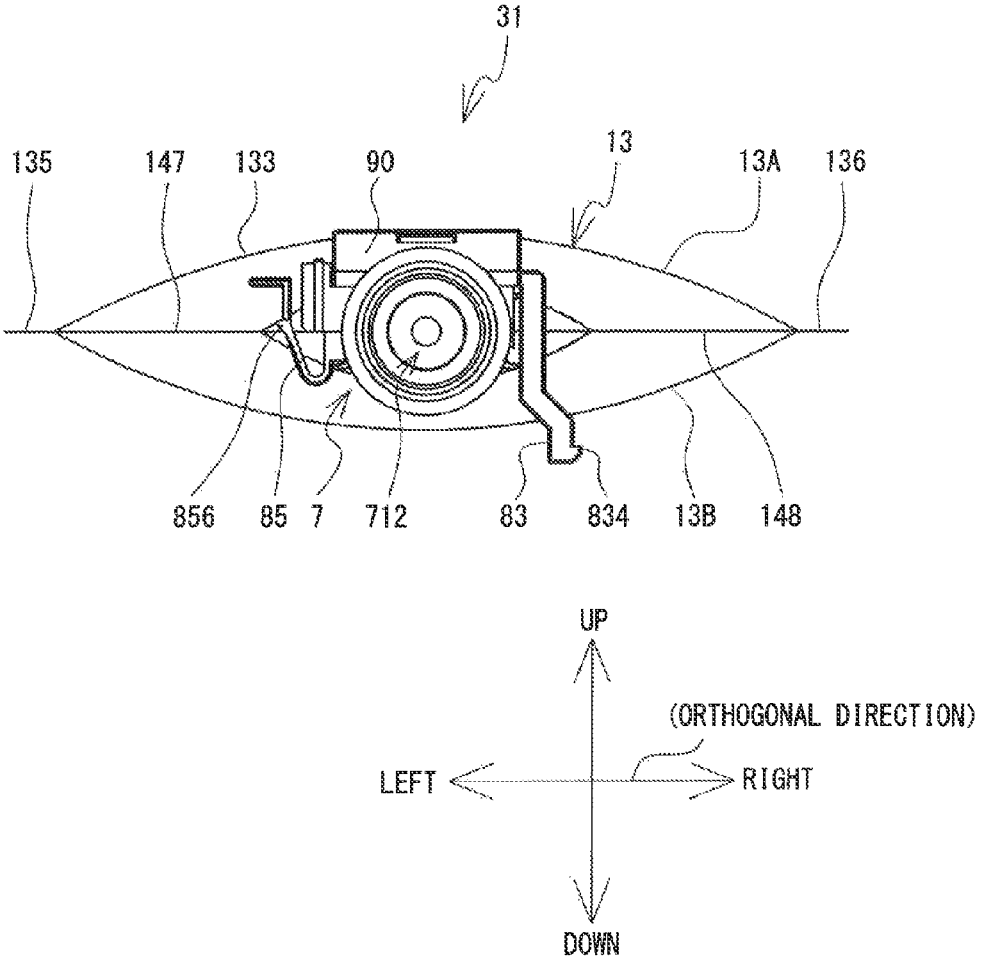
FIG. 7 is a front view of the liquid storage body.

The plug 7 will be explained. As shown in FIG. 5 and FIG. 6, the plug 7 is connected to the first end portion 131 of the liquid storage bag 13. The plug 7 extends in the front-rear direction, which is an X-axis line direction. The X-axis line direction is parallel to the extending direction. The plug 7 is provided with a leading end portion 713, a first plug protruding portion 83, a second plug protruding portion 85, a holder 90, an electric board 98 and the insertion portion 76. The leading end portion 713 on the front side of the plug 7 is a cylindrical shape that extends in the front-rear direction, which is the X-axis line direction. As shown in FIG. 7, the plug 7 has a hollow portion 712. The hollow portion 712 extends toward the rear from the center, in a front view, of the leading end portion 713. The hollow portion 712 causes the interior of the liquid storage portion 133 to communicate with the exterior of the plug 7. The rubber plug (not shown in the drawings) is provided in a part of the hollow portion 712 in the X-axis line direction. The rubber plug seals the hollow portion 712. Therefore, the ink inside the liquid storage portion 133 cannot leak out.

As shown in FIG. 5, the first plug protruding portion 83, the second plug protruding portion 85 and the holder 90 are provided to the rear of the leading end portion 713. As shown in FIG. 7, the first plug protruding portion 83 is positioned to the right of the plug 7. After extending downward from the plug 7, the first plug protruding portion 83 extends diagonally downward and to the right, and the lower end of the first plug protruding portion 83 extends downward. The lower end portion of the first plug protruding portion 83 is provided with a first engagement tab 834. The first engagement tab 834 protrudes to the right from the right side surface on the lower end portion of the first plug protruding portion 83.

The second plug protruding portion 85 is positioned to the left of the plug 7. The second plug protruding portion 85 is a curved plate shape, and deforms elastically in the rightward direction toward the plug 7. The second plug protruding portion 85 extends downward from the plug 7. Then, the second plug protruding portion 85 is curved at its lower end and extends upward. The second plug protruding portion 85 is provided with a second engagement tab 856. The second engagement tab 856 protrudes to the left from the left side surface of the second plug protruding portion 85.

Figure 9:
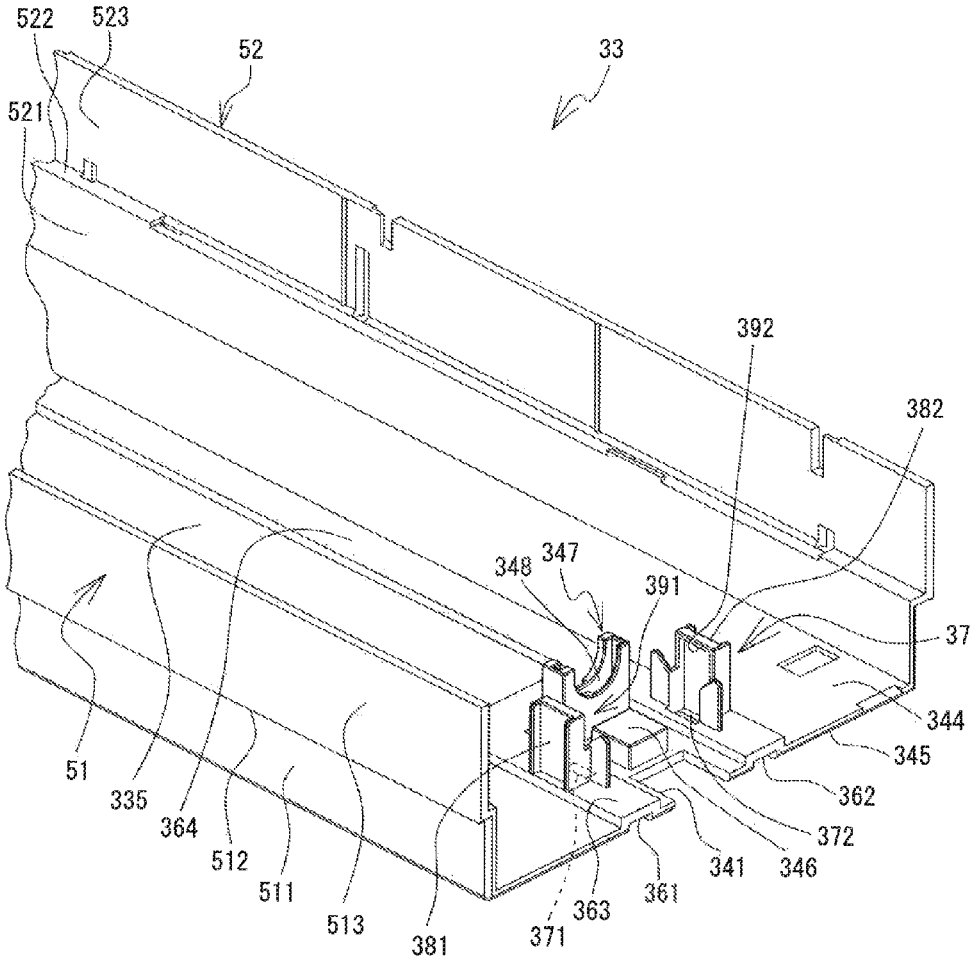
FIG. 9 is a perspective view of a front end portion of a first case.
Figure 9:
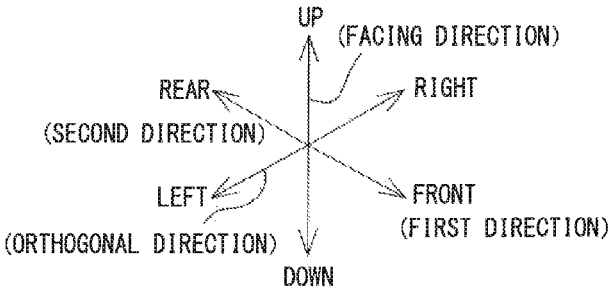

As shown in FIG. 9, when the liquid storage body 31 is mounted in the case 32, the first plug protruding portion 83 engages with a first open portion 372 of the case 32, and the second plug protruding portion 85 engages with a second open portion 391 of the case 32. Details will be described later.

As shown in FIG. 5 and FIG. 7, the holder 90 is provided above the plug 7. A holder opening 901, which is an open portion, is provided in the top surface of the holder 90. The holder 90 holds the electric board 98. The holder opening 901 exposes the top surface of the electric board 98. A placement portion 75 is provided on the extending direction side of the holder 90. The placement portion 75 is a flange shape that protrudes to the outside from the periphery of the plug 7. It is not necessary for the holder 90 to hold the electric board 98.

The insertion portion 76 is an end portion in the extending direction of the plug 7. The insertion portion 76 is a cylindrical shape that extends in the extending direction. The insertion portion 76 is provided in a state of being arranged between the sheets 13A and 13B and thus being inserted inside the liquid storage portion 133. The sheets 13A and 13B are thermally welded with the insertion portion 76 sandwiched therebetween.

The case 32 will be explained. In the following explanation, the frontward direction is also referred as a "first direction." The rearward direction, which is the opposite direction to the first direction, is also referred to as a "second direction." The up-down direction, in which a first inner surface 344 and a second inner surface 644 that will be explained later aligned facing each other, is also referred to as a "facing direction."

Figure 8:
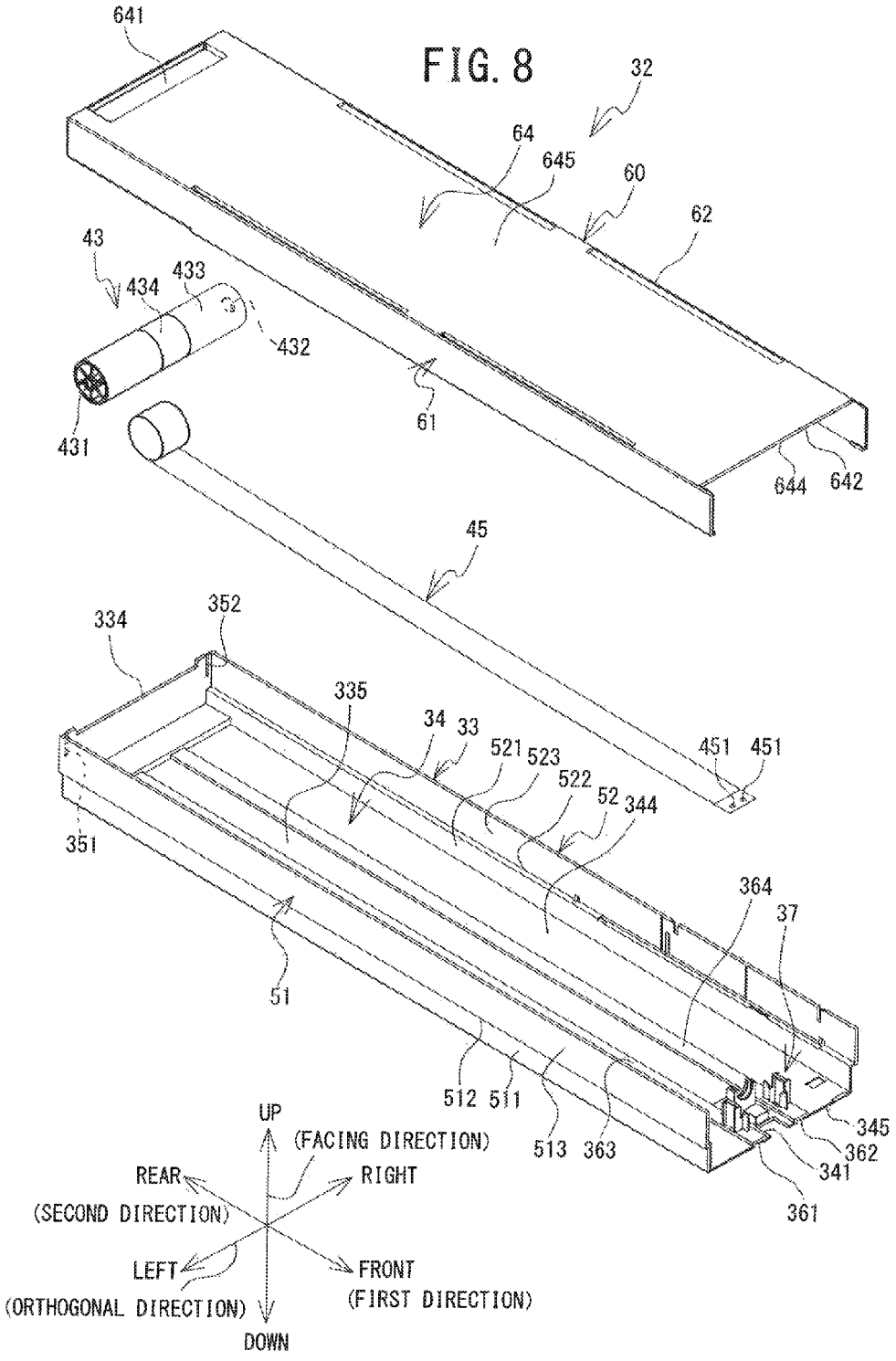
FIG. 8 is an exploded perspective view of a case.

As shown in FIG. 3, the case 32 has a box-shape which is long in the front-rear direction. The case 32 has an end open portion 321 which opens at an end portion of the case 32 on the first direction side. As shown in FIG. 3, FIG. 4 and FIG. 8, the case 32 includes a first case 33, a second case 60, a shaft portion 43, an elastic member 45 and a detection portion 46. The first case 33 supports the liquid storage body 31. The second case 60 is arranged above the first case 33. The second case 60 is capable of sliding with respect to the first case 33 in the first direction and the second direction (refer to FIG. 3 and FIG. 4).

Figure 10:
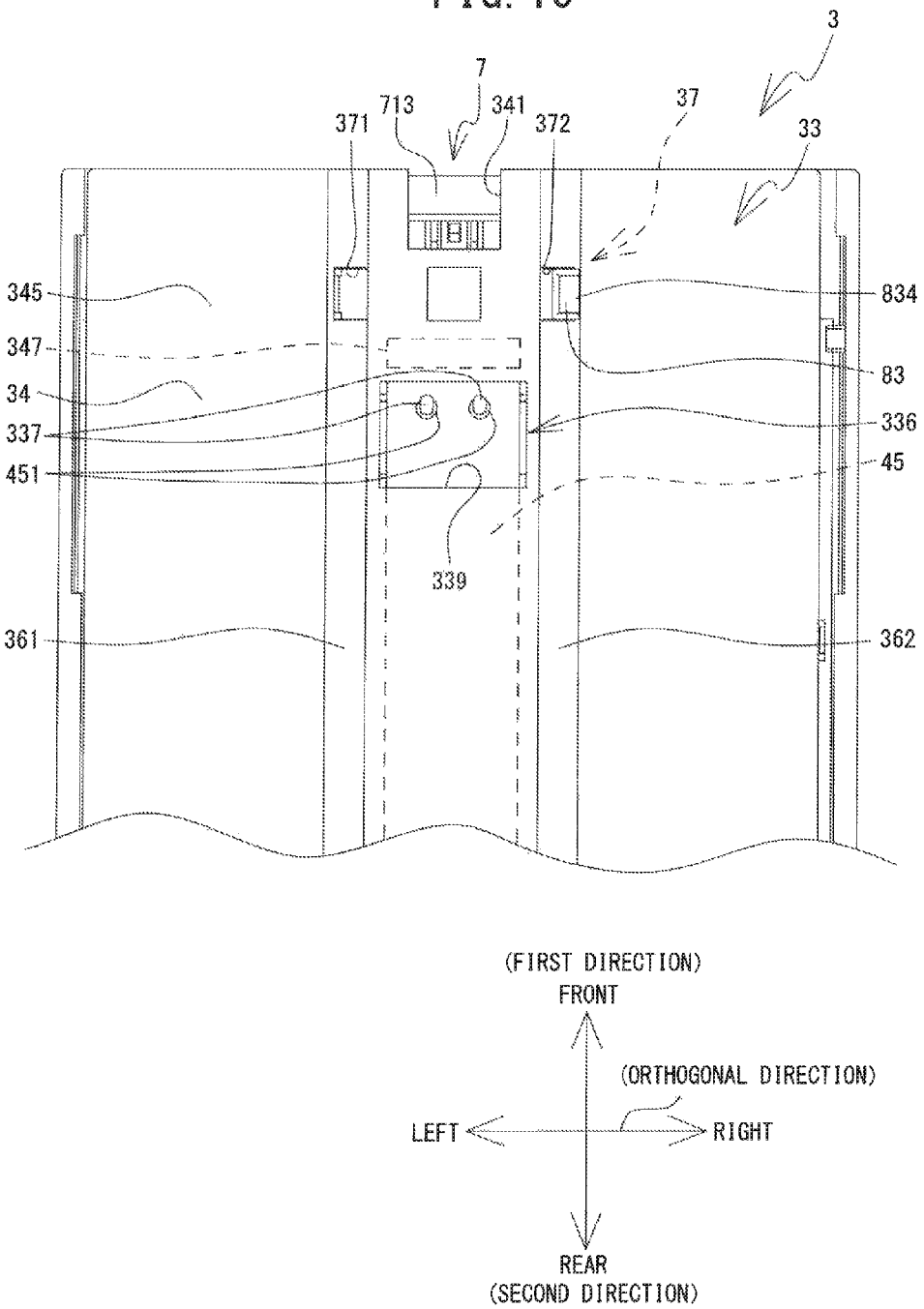
FIG. 10 is a bottom view of a front end portion of the cartridge.

As shown in FIG. 8, the first case 33 is provided with a support wall portion 34, a pair of side walls 51 and 52, a rear wall portion 334, a case recessed portion 335 and a mounting portion 336 (refer to FIG. 10). The support wall portion 34 is provided with the upper-side first inner surface 344 that extends in the first direction from the rear end side of a bottom portion of the first case 33, and with a first outer surface 345 that is on the opposite side to the first inner surface 344. The orthogonal direction is a direction that is parallel to the first inner surface 344 and that is orthogonal to the first direction. The pair of side walls 51 and 52 extend upward from the end portion in the orthogonal direction of the first inner surface 344. The rear wall portion 334 extends upward from the rear end portion of the first inner surface 344. The end portion in the orthogonal direction of the rear wall portion 334 is provided with slits 351 and 352 that extend downward from the upper end of the rear wall portion 334. When the second case 60 slides in the second direction with respect to the first case 33, protruding wall portions 65 and 66 (refer to FIG. 11, to be explained later) of the second case 60 pass through the inside of the slits 351 and 352. The end portion of the first case 33 on the first direction side is an open portion that does not have a wall portion.

As shown in FIG. 8 and FIG. 9, a recessed portion 341 that is recessed in a rectangular shape toward the second direction is provided in the center, in the left-right direction, of the end portion of the support wall portion 34 on the first direction side. The first outer surface 345 is provided with two groove portions 361 and 362 that are recessed in the upward direction. The groove portion 361 is provided to the left of the recessed portion 341, and extends from the front end of the support wall portion 34 to a front side of the rear end. The groove portion 362 is provided to the right of the recessed portion 341 and extends from the front end of the support wall portion 34 to the front side of the rear end. By providing the groove portions 361 and 362 in the first outer surface 345, protruding portions 363 and 364 that protrude upward are provided above the groove portions 361 and 362 in the first inner surface 344.

As shown in FIG. 9, a plug support portion 37 that supports the plug 7 is provided to the rear of the recessed portion 341. The plug support portion 37 includes a first open portion 371 and the first open portion 372, open wall portions 381 and 382, a first support portion 346 and a second support portion 347. Each of the first open portions 371 and 372 is formed in a rectangular shape in a plan view and penetrates the support wall portion 34 in the up-down direction, at a front portion of each of the groove portions 361 and 362, respectively (refer to FIG. 9 and FIG. 10). The open wall portions 381 and 382 extend upward from the protruding portions 363 and 364, respectively. The open wall portions 381 and 382 are respectively provided with the second open portion 391 and a second open portion 392, which have a rectangular shape in a side view and which are respectively provided on the inside of the open wall portions 381 and 382 in the orthogonal direction. The first open portion 371 is provided on the surface of the protruding portion 363 at a position which is enclosed with the open wall portions 381 and 382 in the orthogonal direction, wherein each of the open wall portions 381 and 382 forms the second open portion 391 and a second open portion 392, respectively. In the same manner, the first open portion 372 is provided on the surface of the protruding portion 364 at a position which is enclosed with the open wall portions 381 and 382 in the orthogonal direction.

When the liquid storage body 31 is mounted in the first case 33, the lower end of the first plug protruding portion 83 of the plug 7 protrudes from the first open portion 372 and is positioned in the groove portion 362. The first engagement tab 834 engages with the groove portion 362 (refer to FIG. 10). The second engagement tab 856 engages with the second open portion 391. The first open portions 371 and 372 are symmetrical with each other in the orthogonal direction with the first support portion 346 (to be explained later) as a center point between them. The second open portions 391 and 392 are symmetrical with each other in the orthogonal direction with the first support portion 346 as the center point between them. Thus, for example, when the plug 7 is a plug on which the first plug protruding portion 83 is arranged on the left side and the second plug protruding portion 85 is arranged on the right side, the lower end of the first plug protruding portion 83 protrudes from the first open portion 371 and is positioned in the groove portion 361. The first engagement tab 834 engages with the groove portion 361. The second engagement tab 856 engages with the second open portion 391.

As shown in FIG. 9, the first support portion 346 is positioned on the second direction side of the recessed portion 341 in the support wall portion 34 and is also positioned between the groove portion 361 and the groove portion 362. The first support portion 346 has a rectangular shape in a plan view and protrudes upward. The first support portion 346 supports the bottom surface of the plug 7. The second support portion 347 is provided on the second direction side of the first support portion 346. The second support portion 347 is a wall portion that extends upward from the support wall portion 34 and that is long in the left-right direction. The upper end of the second support portion 347 is recessed downward in a U shape in a front view. A recessed portion 348, which is recessed downward in the left-right direction, is provided in a center portion, in the front-rear direction, of the second support portion 347. When supporting the plug 7 on the plug support portion 37, an operator arranges the lower end of the placement portion 75 (refer to FIG. 5) of the plug 7 in the recessed portion 348 of the second support portion 347.

The case recessed portion 335 is positioned on the second direction side of the plug support portion 37. As shown in FIG. 8, the case recessed portion 335 is a recessed portion that is recessed downward between the protruding portions 363 and 364. The case recessed portion 335 extends in the first direction from a front side of the rear end portion of the support wall portion 34. The elastic member 45 is positioned on the inside of the case recessed portion 335. The case recessed portion 335 supports the elastic member 45. The elastic member 45 is a variable load plate spring.

As shown in FIG. 10, the mounting portion 336 is positioned on the second direction side of the plug support portion 37. The mounting portion 336 is a recessed portion that is formed to open downward and is provided inside of a projection which projects upward from the first inner surface 344 and the first outer surface 345 that is a bottom face of the first case 33. The mounting portion 336 is provided with two protrusions 337 that protrude downward from the first outer surface 345. The two protrusions 337 are aligned side by side in the orthogonal direction.

The case recessed portion 335 is provided with a mounting open portion 339. The mounting open portion 339 penetrates the support wall portion 34 in the up-down direction, on the second direction side of the mounting portion 336. The end portion on the first direction side of the elastic member 45 is provided with two round hole portions 451 that are aligned side by side in the orthogonal direction. When the elastic member 45 is arranged in the case recessed portion 335 and mounted in the mounting portion 336, the end portion on the first direction side of the elastic member 45 is positioned on the side of the first outer surface 345, via the mounting open portion 339. The two protrusions 337 are inserted through the inside of the two round hole portions 451. As shown in FIG. 4 and FIG. 8, the elastic member 45 extends in the second direction. The shaft portion 43 takes up the end portion on the second direction side of the elastic member 45. A restoring force in the first direction is generated by the elastic member 45. Thus, the elastic member 45 urges the shaft member 43 in the first direction.

Figure 11:
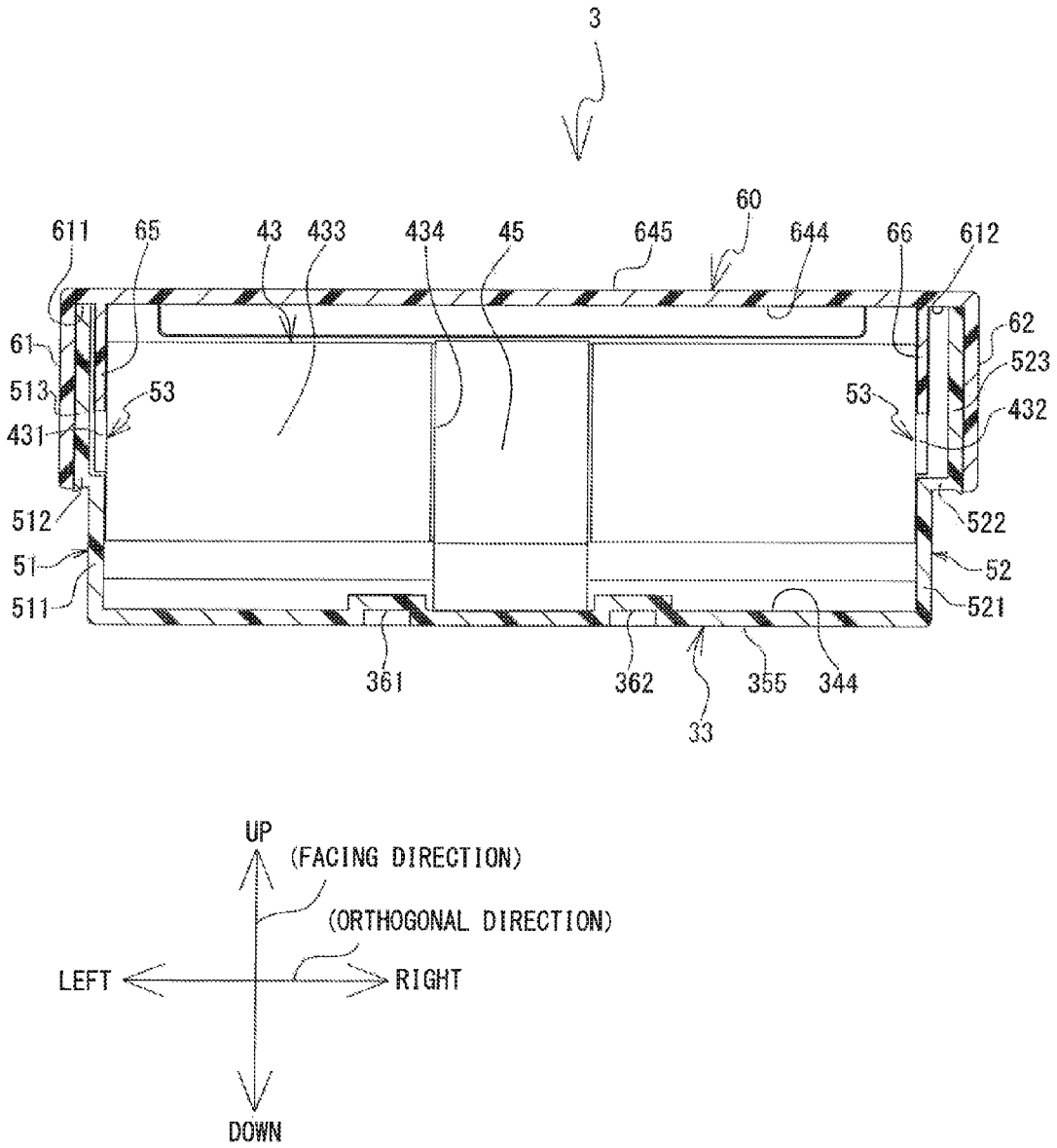
FIG. 11 is a cross-sectional view along a line A-A shown in FIG. 3.

The pair of side walls 51 and 52 will be explained in detail. An illustration of the liquid storage bag 13 is omitted from FIG. 11. As shown in FIG. 8 and FIG. 11, the left side wall 51 is provided with a first portion 511, a second portion 512 and a third portion 513. The right side wall 52 is provided with a first portion 521, a second portion 522 and a third portion 523. The first portions 511 and 521 are wall portions that extend upward from each of the lower end portions of the side walls 51 and 52. The first portions 511 and 521 protrude upward from each of end portions of the first inner surface 344 in the orthogonal direction. The first portions 511 and 521 are provided from each of end portions in the second direction of the first case 33 and extended along the first direction. The protruding end portions 431 and 432 are clamped and supported by upper ends of the first portions 511 and 512 and lower ends of the protruding wall portions 65 and 66 of the second case 60 (refer to FIG. 11).

The second portions 512 and 522 protrude outward of the case 3 in the orthogonal direction from the upper ends of the first portions 511 and 521. The third portions 513 and 523 extend upward from the end portions of the second portions 512 and 522.

The shaft portion 43 will be explained. As shown in FIG. 8 and FIG. 11, the shaft portion 43 is a circular column and extends in the orthogonal direction. An outer peripheral surface 433 of the shaft portion 43 is smooth in the peripheral direction. The shaft portion 43 is provided with the protruding end portions 431 and 432, and a shaft recessed portion 434. The protruding end portions 431 and 432 protrude, respectively, in the orthogonal direction from the pair of end portions of the shaft portion 43 in the orthogonal direction. The shaft recessed portion 434 is a recessed portion that is recessed toward the center axis of the shaft portion 43, in the outer peripheral surface 433 of the shaft portion 43. The shaft recessed portion 434 is provided in a center portion, in the orthogonal direction, of the shaft portion 43. The shaft recessed portion 434 takes up the end portion on the second direction side of the elastic member 45.

As shown in FIG. 11, the protruding end portions 431 and 432 are positioned between the first portions 511 and 521 of the first case 33 and the protruding wall portions 65 and 66 (to be explained later) of the second case 60. When the shaft portion 43 moves as a result of the urging force of the elastic member 45, the protruding end portions 431 and 432 move along movement paths 53 (refer to FIG. 11 and FIG. 15A), which extend in the front-rear direction and which are formed by the first portions 511 and 521 and the protruding wall portions 65 and 66.

The shaft portion 43 advances in the first direction while taking up the liquid storage bag 13 and thus gathering the ink toward the plug 7. The further the shaft portion 43 is positioned in the first direction, the smaller a remaining amount of ink inside the liquid storage portion 133. Thus, if the position of the shaft portion 43 in the first direction is displayed, it is possible to display the remaining amount of ink inside the liquid storage portion 133. The case 32 has a detection portion (not shown in the drawings) for displaying the remaining amount of ink.

The second case 60 will be explained. As shown in FIG. 8 and FIG. 11 to FIG. 13, the second case 60 is provided with an upper wall portion 64, a pair of side walls 61 and 62, the protruding wall portions 65 and 66 (refer to FIG. 11), groove portions 611 and 612 (refer to FIG. 11) and pressing wall portions 67 and 68 (refer to FIG. 12). The upper wall portion 64 extends in the first direction from the rear end portion of the second case 60. The upper wall portion 64 is provided with a second inner surface 644, which is the bottom surface of the upper wall portion 64, and a second outer surface 645, which is on the opposite side of the second inner surface 644. As shown in FIG. 8, the first inner surface 344 of the first case 33 and the second inner surface 644 of the second case 60 face each other in the facing direction. The end portion on the second direction side of the second outer surface 645 has an outer surface recessed portion 641, which is recessed downward. The outer surface recessed portion 641 has a rectangular shape that is long in the orthogonal direction in a plan view. When the operator slides the second case 60 with respect to the first case 33, the operator moves the second case 60 by placing his/her finger in the outer surface recessed portion 641, for example.

Figure 12:
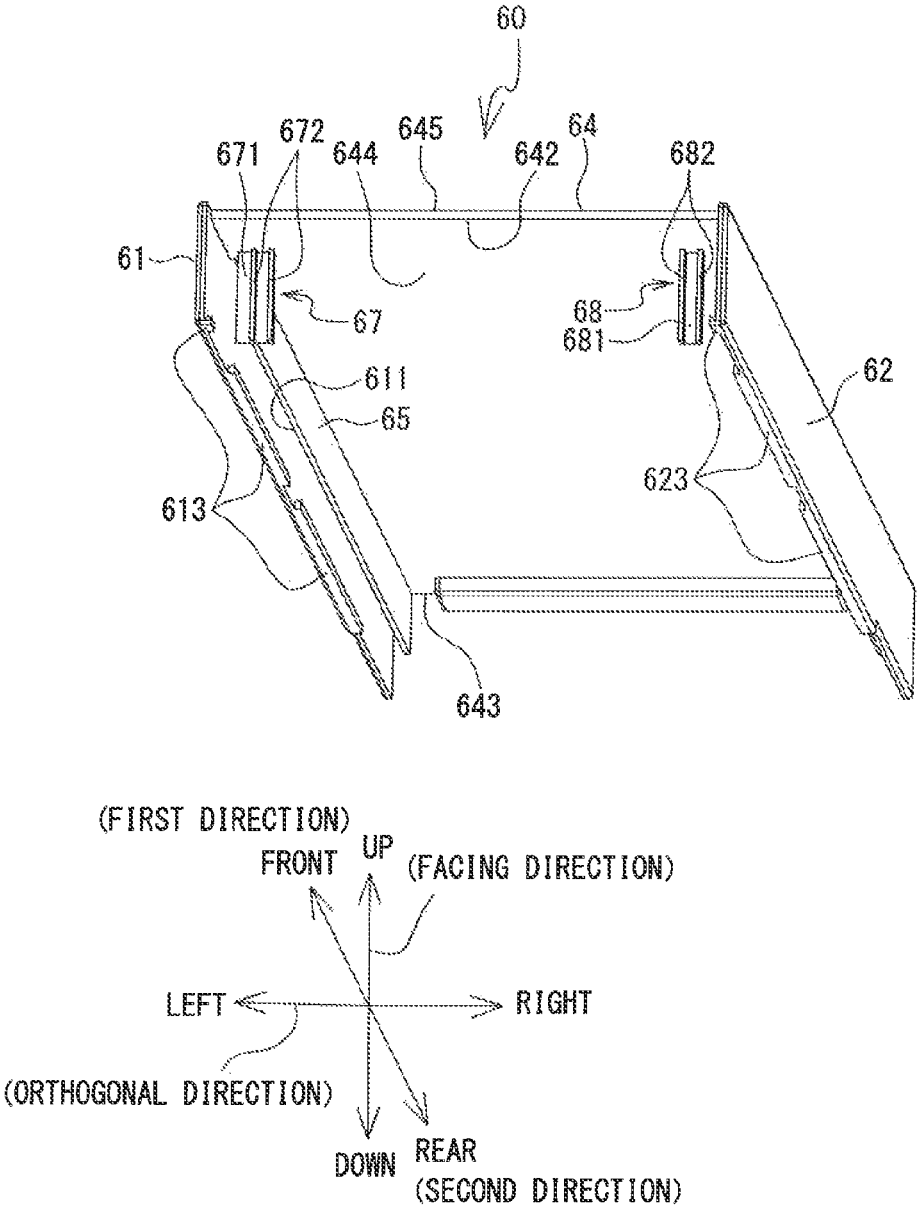
FIG. 12 is a perspective view of a second case.
Figure 13:
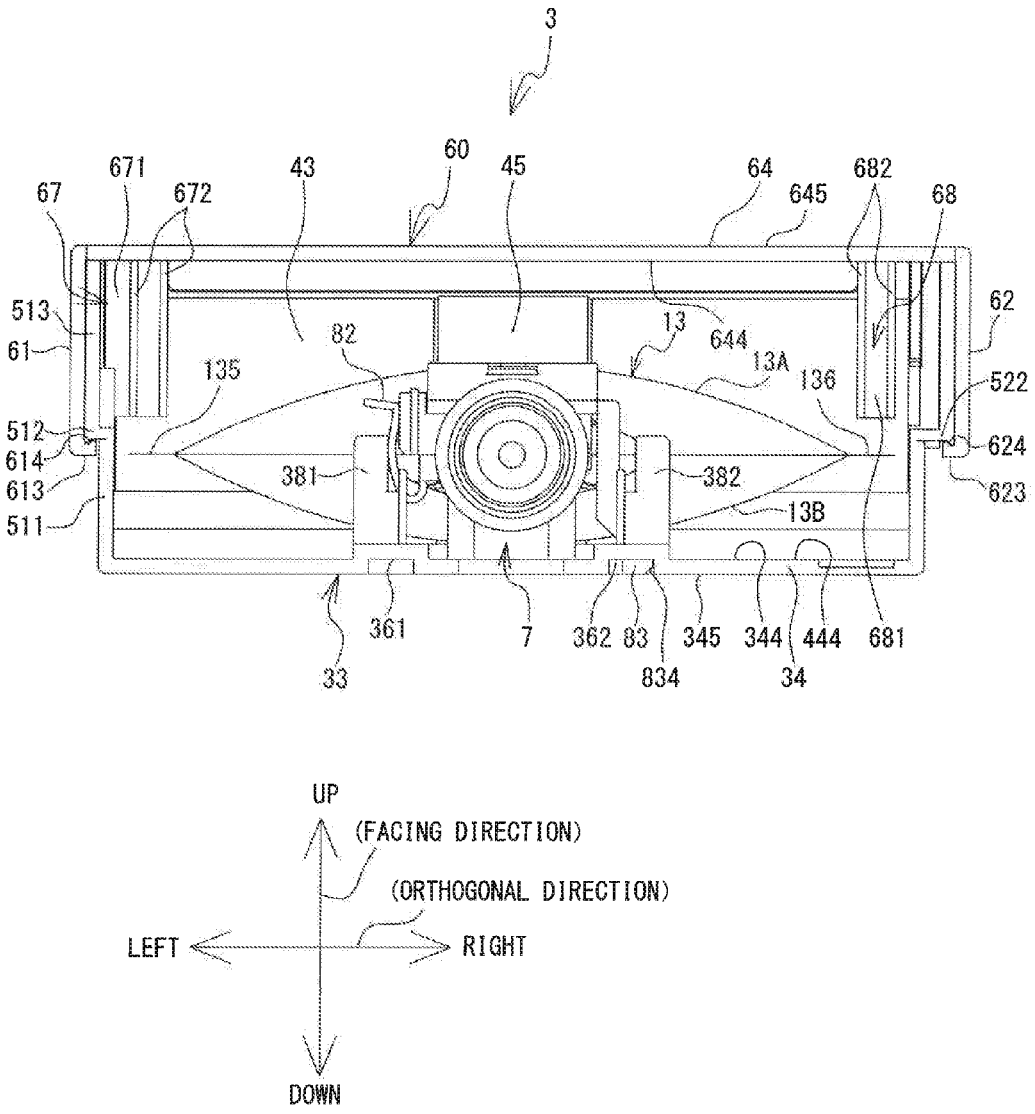
FIG. 13 is a front view of the cartridge.
Figure 14:
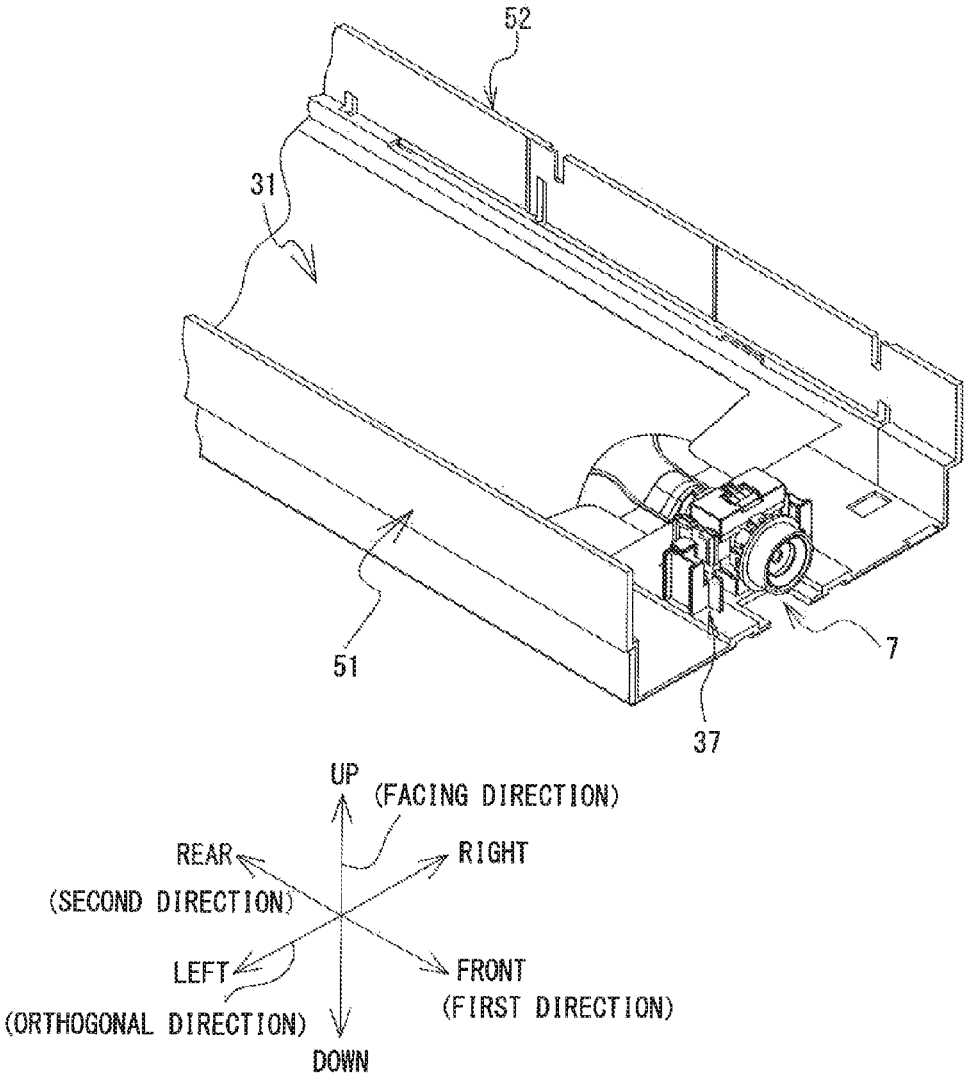
FIG. 14 is a perspective view of the front end portion of the first case.

The pair of side walls 61 and 62 respectively extend downward from the end portions in the orthogonal direction of the second inner surface 644. As shown in FIG. 12 and FIG. 13, each of the lower end portions of the pair of side walls 61 and 62 are provided with a plurality of leading end wall portions 613 and 623. The leading end wall portions 613 and 623 respectively protrude from the side walls 61 and 62 toward the inside in the orthogonal direction.

As shown in FIG. 13, when the second case 60 is mounted on the first case 33, the pair of side walls 61 and 62 of the second case 60 are positioned on the outside of the pair of side walls 51 and 52 of the first case 33. Namely, the first case 33 is an inner case and the second case 60 is an outer case. The second portions 512 and 522 of the side walls 51 and 52 face upper surfaces 614 and 624, which are surfaces of the leading end wall portions 613 and 623 on the side of the second inner surface 644. As a result, the second portions 512 and 522 and the leading end wall portions 613 and 623 engage with each other.

As shown in FIG. 12, the end portion on the first direction side of the second case 60 is provided with an open portion 642, which opens in the front-rear direction. The end portion on the second direction side of the second case 60 is provided with an open portion 643, which opens in the front-rear direction.

As shown in FIG. 11, the protruding wall portions 65 and 66 are wall portions that are provided facing the side walls 61 and 62, respectively, on the inside of the side walls 61 and 62 in the orthogonal direction. The protruding wall portions 65 and 66 extend from the second inner surface 644 toward the first inner surface 344 (refer to FIG. 12) between the end portion on the second direction side of the second case 60 and a position which is near to the end portion on the first direction side of the second case 60. The groove portion 611 is a groove that is recessed upward and that is formed between the protruding wall portion 65 and the side wall 61. The groove portion 612 is a groove that is recessed upward and that is formed between the protruding wall portion 66 and the side wall 62. The third portions 513 and 523 of the pair of side walls 51 and 52 of the first case 33 are positioned inside the groove portions 611 and 612, respectively.

As shown in FIG. 12, the pressing wall portions 67 and 68 protrude downward, (namely, to the side of the first inner surface 344), from the end portions in the first direction of the second inner surface 644. The pressing wall portions 67 and 68 are positioned further to the first direction side than the shaft portion 43 when the shaft portion 43 is positioned in a second position that will be explained later (refer to FIG. 15A). As shown in FIG. 13, the pressing wall portions 67 and 68 are provided on the end portions in the orthogonal direction of the second case 60. The elastic member 45 are positioned between the pressing wall portions 67 and 68. As shown in FIG. 12 and FIG. 13, the pressing wall portion 67 is provided with a first wall portion 671 and two second wall portions 672. The pressing wall portion 68 is provided with a first wall portion 681 and two second wall portions 682. Each of the first wall portions 671 and 681 is a wall portion that faces the shaft portion 43 and that has a flat surface that is parallel to the orthogonal direction. The two second wall portions 672 protrude in the first direction from the center portion and the right end portion in the orthogonal direction of the first wall portion 671. The two second wall portions 682 protrude in the first direction from the end portions in the orthogonal direction of the first wall portion 681.

Figure 15A:
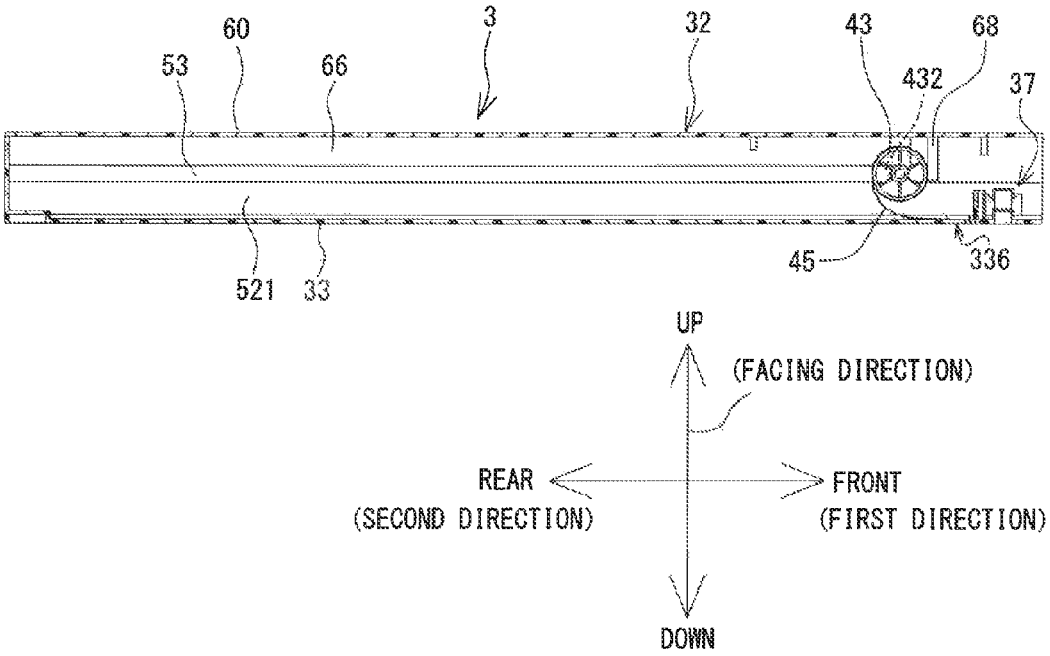
FIG. 15A is a cross-sectional view along a line B-B shown in FIG. 3.
Figure 15B:
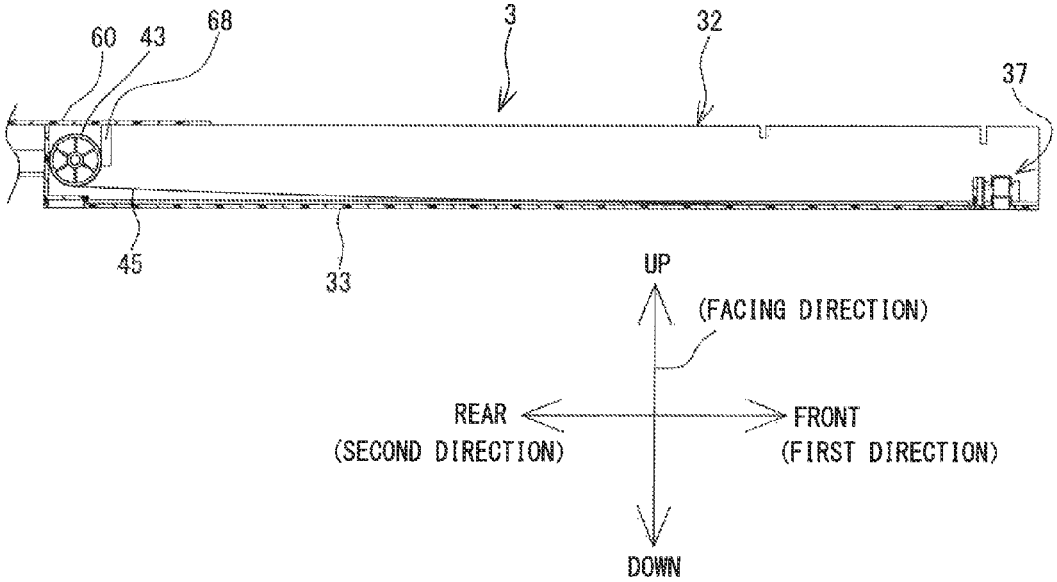
FIG. 15B is a cross-sectional view and is a continuation of FIG. 15A.

An operation will be explained in which the operator assembles the case 32, mounts the liquid storage body 31 in the case 32 and mounts the case 32 in the cartridge mounting portion 8. For example, when the cartridge 3 is manufactured in a manufacturing factory of the cartridge 3, or when the cartridge 3 is used in a factory or a household that uses the printer 1, the operator performs the operation to assemble the case 32 and mount the liquid storage body 31 in the case 32. For example, in the factory or such place that uses the printer 1, at a time of replacing the liquid storage body 31 inside the cartridge 3, the operator first removes the used liquid storage body 31 from the case 32 and then mounts the new liquid storage body 31 in the case 32. In the following explanation, of a movable range of the shaft portion 43, a position furthest to the second direction side as shown in FIG. 15B is referred to as a first position. Of the movable range on the first direction side from the first position, a position that is furthest to the first direction side as shown in FIG. 15A is referred to as the second position. FIG. 15A to FIG. 15D, and FIG. 16A to FIG. 16D are simplified diagrams, and an illustration of the detection portion 46 etc. is omitted. In FIG. 15A to FIG. 15D and FIG. 16A to FIG. 16D, of the pressing wall portions 67 and 68, only the pressing wall portion 68 is shown. In FIG. 15A to FIG. 15D and FIG. 16A to FIG. 16D, the movement paths 53 are only shown in FIG. 15A.

As shown in FIG. 8, at the time of assembly of the case 32, the operator arranges the elastic member 45 in the case recessed portion 335 of the first case 33. The operator arranges the end portion on the first direction side of the elastic member 45 on the mounting portion 336, and takes up the end portion on the second direction side of the elastic member 45 onto the shaft recessed portion 434 of the shaft portion 43. The operator places the protruding end portions 431 and 432 of the shaft portion 43 on the upper side of the first portions 511 and 521, and arranges the shaft portion 43 in the first case 33. The operator arranges the second case 60 on top of the first case 33 while sliding the second case 60 in the second direction from the first direction side of the first case 33. At this time, the protruding end portions 431 and 432 of the shaft portion 43 are positioned between the first portions 511 and 521 of the first case 33 and the protruding wall portions 65 and 66 (refer to FIG. 11). The second case 60 slides in the second direction with respect to the first case 33. The operator arranges the detection portion 46 in the first case 33. The operator assembles the case 32 in the above-described manner. An order of assembly of each structural member is optional and is not limited to the above-described order.

As shown in FIG. 15A, when the liquid storage body 31 is not mounted in the case 32, the shaft portion 43 moves to the second position as a result of the urging force of the elastic member 45. The pressing wall portions 67 and 68 of the second case 60 are positioned on the first direction side of the shaft portion 43. As shown in FIG. 15B, the operator slides the second case 60 in the second direction with respect to the first case 33, and opens the second case 60, which forms a lid of the case 32. With the sliding of the second case 60, the pressing wall portions 67 and 68 push the shaft portion 43 in the second direction and the shaft portion 43 moves to the first position along the movement paths 53. The elastic member 45 is extended according to the movement of the shaft portion 43 toward the first position.

Figure 15C:
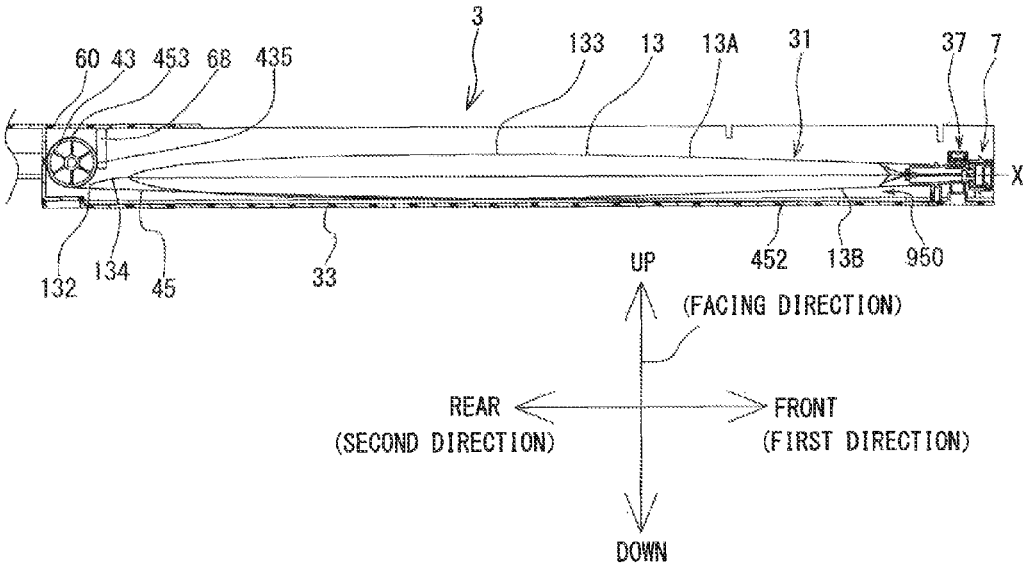
FIG. 15C is a cross-sectional view and is a continuation of FIG. 15B.

The operator grasps the plug 7 of the liquid storage body 31. The second plug protruding portion 85 elastically deforms on the plug 7 side. As shown in FIG. 15C, the operator arranges the liquid storage body 31 in the first case 33 from above the first case 33. At that time, the first plug protruding portion 83 protrudes downward from the first open portion 372. The lower end portion of the first plug protruding portion 83 is positioned inside the groove portion 362 (refer to FIG. 13). The first engagement tab 834 of the first plug protruding portion 83 engages with the groove portion 362 on the first outer surface 345 side. The first support portion 346 and the second support portion 347 support the bottom surface of the plug 7. The second engagement tab 856 of the second plug protruding portion 85 engages with the second open portion 391 (refer to FIG. 9). The second plug protruding portion 85 engages with the second open portion 391 in an elastically deformed state. The plug support portion 37 supports the plug 7 in this way.

As shown in FIG. 15C, in the facing direction, a center position (a position shown on the X-axis line) of the plug 7 supported by the plug support portion 37 is positioned above (on the second inner surface 644 side of) a lower end portion 452 (the first inner surface 344 side) of the elastic member 45 (refer to FIG. 11). In other words, the center position of the plug 7 is positioned between an upper end portion 453 and the lower end portion 452 of the elastic member 45. The upper end portion 453 is the upper end of the elastic member 45 which is taken up on the shaft portion 43. The lower end portion 452 (refer to FIG. 15C) is a portion of the elastic member 45 that is in contact with the first inner surface 344 (refer to FIG. 8). The center position of the plug 7 is the same position as the center of the hollow portion 712 (refer to FIG. 7).

The liquid storage bag 13 is positioned on the upper surface side of the support wall portion 34 and the elastic member 45. The end portion 435 on the first direction side of the shaft portion 43 that is in the first position is positioned further to the first direction side than the second end portion 132 on the second direction side of the liquid storage bag 13.

Figure 15D:
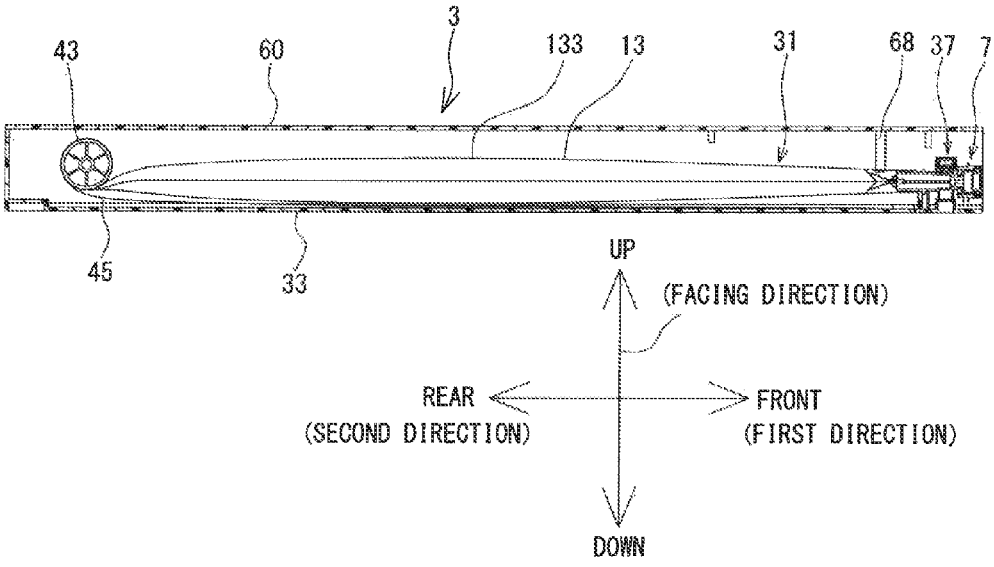
FIG. 15D is a cross-sectional view and is a continuation of FIG. 15C.

As shown in FIG. 15D, the operator moves the second case 60 in the first direction with respect to the second case 33, and closes the second case 60 that forms the lid of the case 32. With the moving of the second case 60 in the first direction, the pressing wall portions 67 and 68 move in the first direction. Pressing from the pressing wall portions 67 and 68 to the shaft portion 43 is released. Therefore, due to the urging force of the elastic member 45, the shaft portion 43 moves in the first direction while rotating in the clockwise direction in a left side view. The elastic member 45 is wound in the clockwise direction in a left side view. The shaft portion 43 takes up the liquid storage bag 13 from the second end portion 132 on the second direction side toward the first direction side. As the extension portion 134 is a flat region in which no ink is stored, the shaft portion 43 easily takes up the extension portion 134. The shaft portion 43 starts taking up the liquid storage portion 133 from the extension portion 134. At the time of taking up of the liquid storage portion 133 by the shaft portion 43, the shaft portion 43 pushes the ink inside the liquid storage portion 133 in the first direction toward the plug 7. The movement of the shaft portion 43 stops at a position at which the force causing the shaft portion 43 to move in the first direction due to the urging force of the elastic member 45 becomes equal to a force with which the liquid storage portion 133 pushes the shaft portion 43 in the second direction. The operator acquires a completed unit of the cartridge 3, in which the new liquid storage body 31 is mounted in the case 32. In the meantime, as shown in FIG. 13, each of the pressing wall portions 67 and 68 is respectively located at the end portion in the orthogonal direction of the second case 60. Therefore, the pressing wall portions 67 and 68 do not interfere with the liquid storage portion 133 when the pressing wall portions 67 and 68 move toward the first direction.

The operator pushes the cartridge 3 into the open portion 120 from the front end side of the cartridge 3, and thus mounts the cartridge 3 in the cartridge mounting portion 8 (refer to FIG. 2). As described above, the hollow needle pierces the rubber plug that is provided in the plug 7 of the liquid storage body 31 stored in the cartridge 3, in order to lead out the liquid from the liquid storage body 31.

Figure 16A:
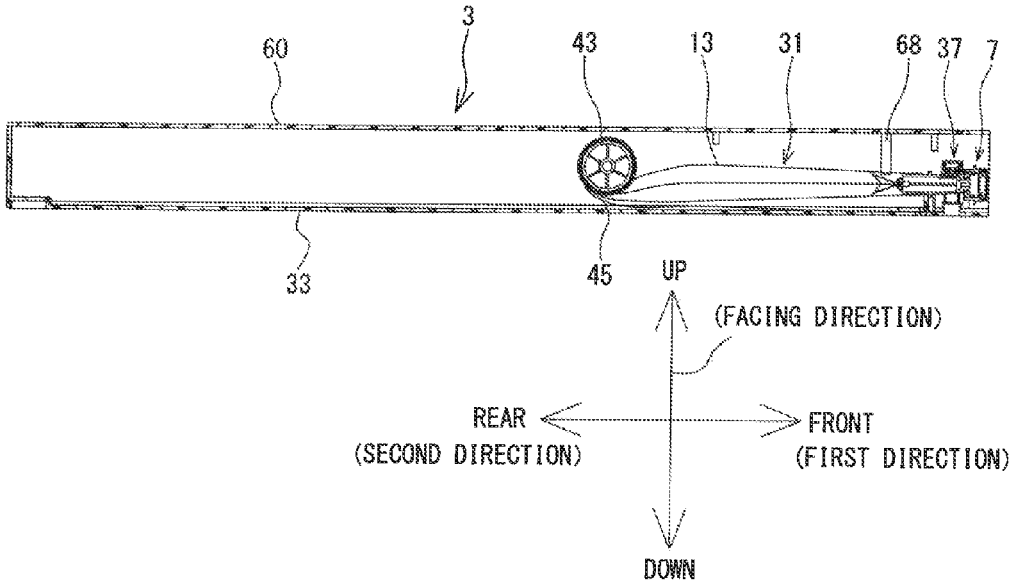
FIG. 16A is a cross-sectional view and is a continuation of FIG. 15D.
Figure 16B:
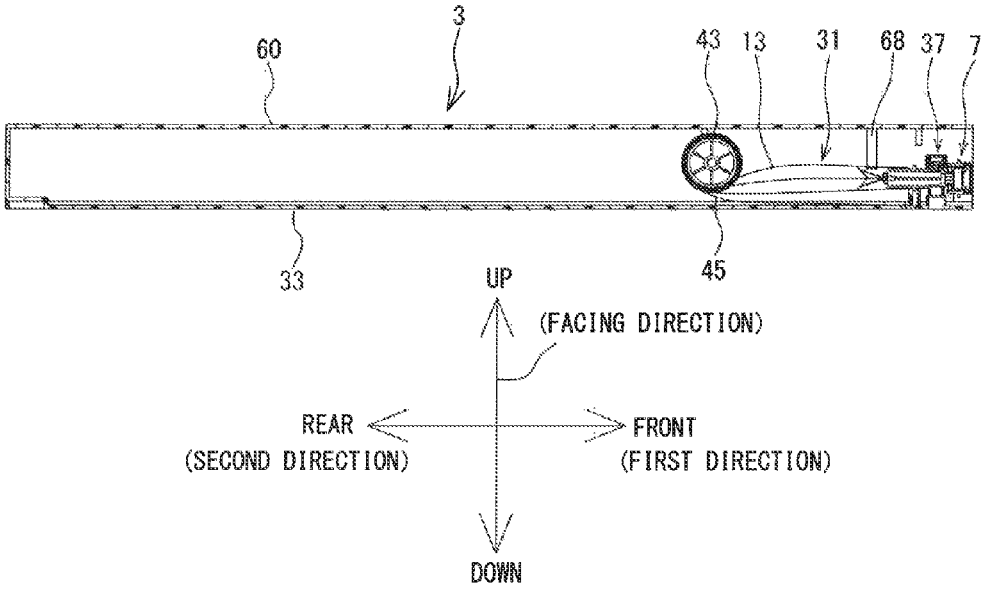
FIG. 16B is a cross-sectional view and is a continuation of FIG. 16A.
Figure 16C:
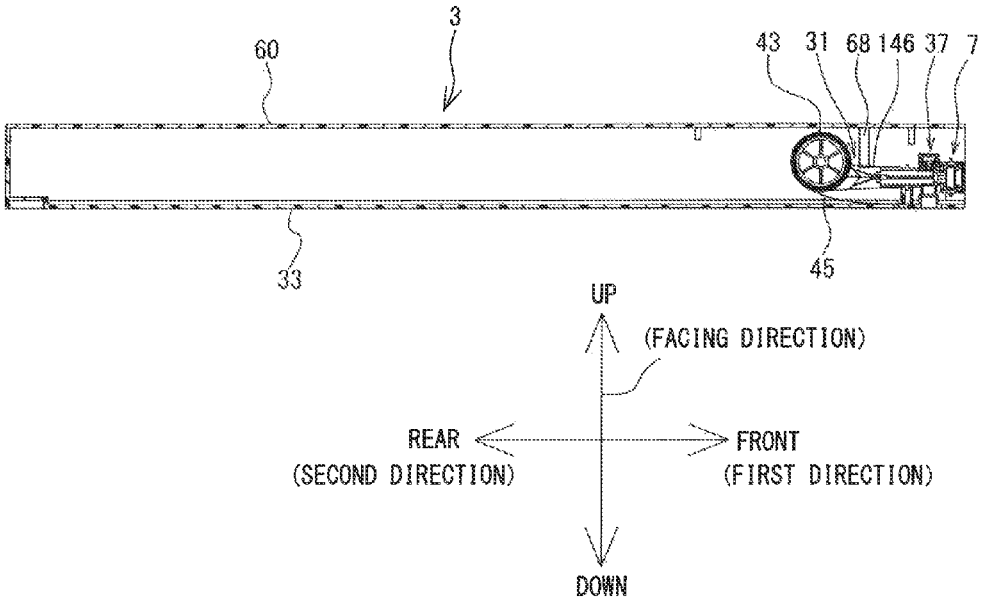
FIG. 16C is a cross-sectional view and is a continuation of FIG. 16B.

At a time of a printing operation, the ink inside the liquid storage portion 133 flows out to the outside of the liquid storage body 31 via the hollow needle. The ink flowing outside of the liquid storage body 31 flows to each of the nozzles. The nozzles of the printer 1 discharge the ink. As shown in FIG. 16A to FIG. 16C, along with the leading out of the ink from the liquid storage body 31, the shaft portion 43 moves in the first direction while taking up the liquid storage portion 133 as a result of the urging force of the elastic member 45.

As shown in FIG. 16C, the shaft portion 43 moves as far as the curved area 146 of the liquid storage bag 13. As described above, in the curved area 146, the sheets 13A and 13B are curved in a direction to separate from each other (in the up-down direction) along the insertion portion 76 (refer to FIG. 5). Thus, it is harder to take up the curved area 146 than a portion further to the second direction side of the curved area 146. Therefore, the movement of the shaft portion 43 stops at the curved area 146. A position at which the shaft portion 43 has stopped is an end position of the movement of the shaft portion 43. The end position of the movement of the shaft portion 43 may be further to the first direction side than the position shown in FIG. 16C.

Figure 16D:
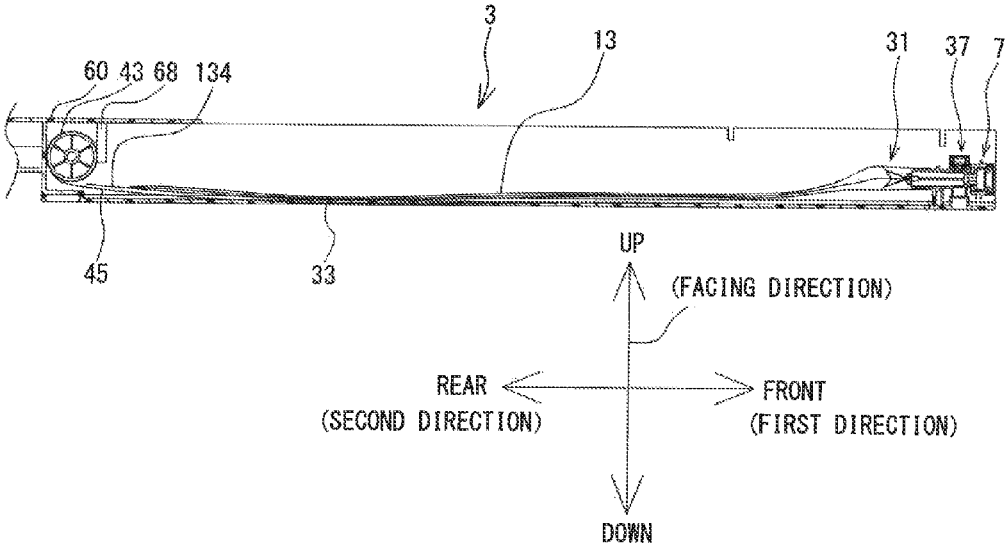
FIG. 16D is a cross-sectional view and is a continuation of FIG. 16C.

The operator removes the cartridge 3 from the cartridge mounting portion 8 and replaces the liquid storage body 31 after the ink has been led out. When the operator moves the second case 60 in the second direction with respect to the first case 33, the pressing wall portions 67 and 68 resist the urging force of the elastic member 45 and move the shaft portion 43, which has taken up the liquid storage bag 13, in the second direction. As a result, as shown in FIG. 16D, the liquid storage bag 13 is apart from the shaft portion 43. The operator removes the liquid storage body 31 after the ink has been led out, and mounts the new liquid storage bag 13 in the case 32, as shown in FIG. 15B and FIG. 15C.

Figure 17:
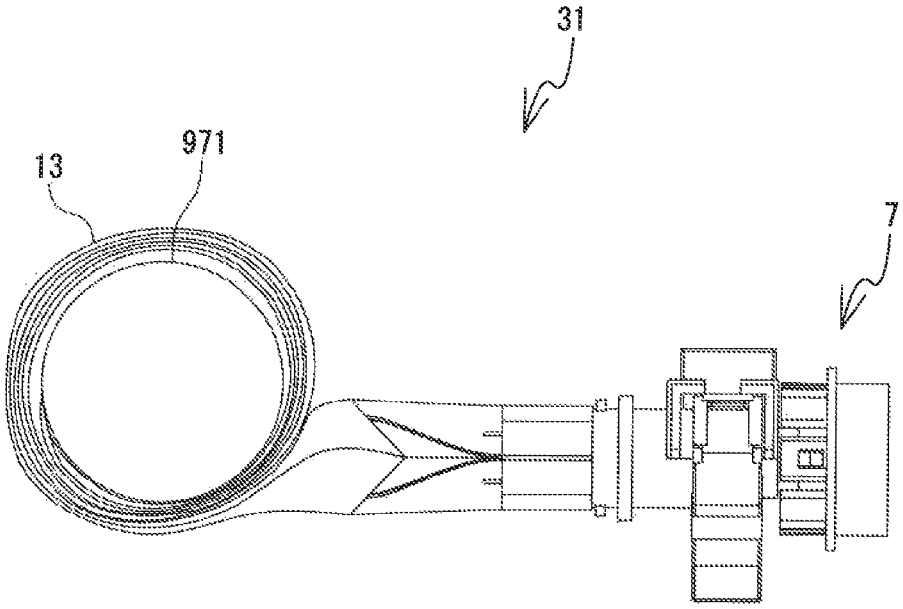
FIG. 17 is a left side view of the liquid storage body showing a state in which an operator has taken up a liquid storage bag.
Figure 18:
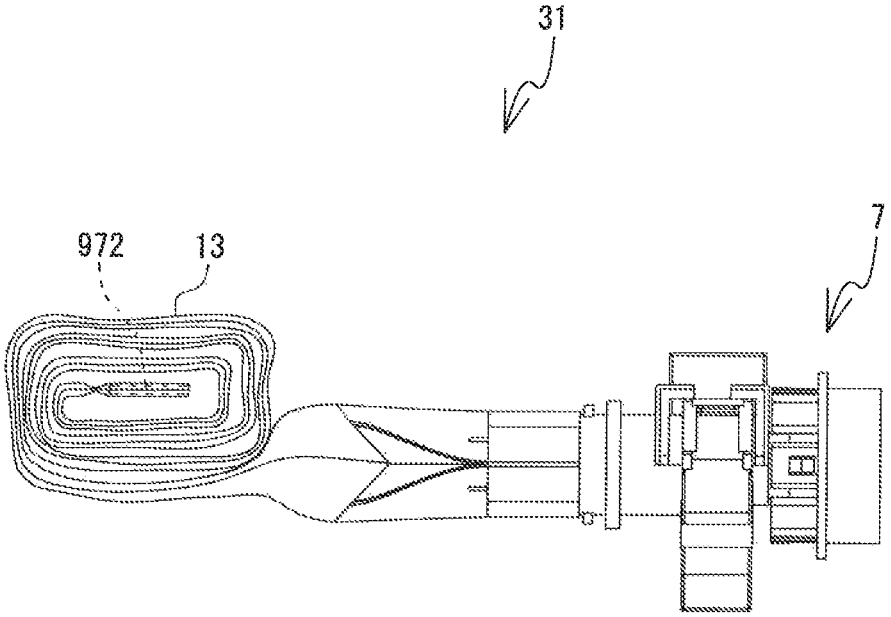
FIG. 18 is a left side view of the liquid storage body showing a state in which the operator has taken up the liquid storage bag using a plate member.

Even if the liquid storage body 31 of the present embodiment is not installed in the printer 1, the operator can manually take up the liquid storage bag 13 and discharge the ink to the outside. As shown in FIG. 17, in a similar manner to the shaft portion 43 taking up the liquid storage bag 13, the operator takes up the liquid storage bag 13 from the extension portion 134 side toward the first direction (the direction opposite to the extending direction). It should be noted that when the operator takes up the liquid storage bag 13, in a similar manner to the shaft portion 43 taking up the liquid storage bag 13, the liquid storage bag 13 may be taken up around a circular columnar member 971 that extends in the orthogonal direction shown in FIG. 17. Further, as shown in FIG. 18, a rectangular plate member 972 may be inserted into a space between the sheets 13A and 13B in the extension portion 134 from the open portion 144 (refer to FIG. 5), and the liquid storage bag 13 may be taken up around the plate member 972. In addition, the operator may perform the operation of taking up the liquid storage body 31 in a state in which the liquid storage body 31 is mounted in the first case 33.

As described above, it is possible to form the cartridge 3 of the present embodiment and use the cartridge 3 for printing. In the present embodiment, the liquid storage bag 13 is taken up by a manual operation by the operator or by the shaft portion 43 (refer to FIG. 15 to FIG. 18). In the liquid storage body 31, the extension portion 134, which is a portion that is first taken up, does not store the ink. Thus, no ink remains in the portion that is first taken up. In the present embodiment, the liquid storage bag 13 is taken up from the extension portion 134 that does not store the ink toward the liquid storage portion 133 that stores the ink. In comparison to a case in which the liquid storage bag 13 is started to be taken up from the liquid storage portion 133 that stores the ink, it is easy to press the ink that is in an end portion of the liquid storage portion 133 on the opposite side to the plug 7 to the side of the plug 7 by the extension portion 134 that has been taken up. As a result, it is difficult for ink to remain in the liquid storage portion 133 that has been taken up. That is, ink is not contained in the taken up liquid storage bag 13. Thus, it is possible to reduce the possibility that a diameter of the taken up liquid storage bag 13 becomes large. Therefore, for example, it is easy for the operator who manually takes up the liquid storage bag 13 to take up the liquid storage bag 13. If a diameter of the taken up liquid storage bag 13 becomes large, there is a possibility that a space in which wrinkles and creases may be caused is generated on the liquid storage portion 133 and ink remains in the space. Also, when the shaft portion 43 takes up the liquid storage bag 13, if the diameter of the taken up liquid storage bag 13 becomes large, it is possible that the liquid storage bag 13 may become stuck between the first inner surface 344 and the second inner surface 644 of the case 32 and it may become difficult for the shaft portion 43 to move in the first direction. The present embodiment can reduce that possibility. If ink is contained in the taken up liquid storage bag 13, it is possible that an amount of ink flowing from the liquid storage body 31 may decrease. The present embodiment can reduce that possibility.

As shown in FIG. 5, the tapered portions 137 and 138 are provided on the extension portion 134. Therefore, in comparison to a case in which the tapered portions 137 and 138 are not provided, a length in the orthogonal direction of the extension portion 134 becomes shorter toward the end portion the extending direction. If there is a corner on the end portion in the orthogonal direction of the extension portion 134, the corner may become bent and the end portion that is bent may be caught. Thus, in this case, it is possible that the diameter of the taken up liquid storage bag 13 becomes large. The present embodiment can reduce this possibility. Thus, it is easy for the operator to wind the liquid storage bag 13. Ink hardly remains in the liquid storage bag 13. Further, it is possible to reduce the possibility that it becomes difficult for the shaft portion 43 to move in the first direction.

When the sheets 13A and 13B are bonded over the whole of the extension portion 134, a bonded area becomes large and an amount of heat used to perform the bonding increases. From the perspective of reducing manufacturing costs, it is preferable for the bonded area of the sheets 13A and 13B in the extension portion 134 to be smaller. However, when the sheets 13A and 13B are bonded around the periphery of the extension portion 134 without providing the open portions 143, 144 and 145, it is possible that air may remain in the extension portion 134. In this case, it is possible that the air remaining in the extension portion 134 may be included when the liquid storage bag 13 is taken up, thus causing the diameter of the taken up liquid storage bag 13 to become large.

In the present embodiment, the open portions 143, 144 and 145 are provided in the extension portion 134. In comparison to a case in which the sheets 13A and 13B are bonded around the whole periphery of the extension portion 134, the air is easily discharged to the outside of the liquid storage bag 13 from the open portions 143, 144 and 145 when the extension portion 134 is taken up. Thus, it is difficult for air to remain in the extension portion 134. If air remains in the extension portion 134, it is possible that the diameter of the taken up liquid storage bag 13 may become large. The present embodiment can reduce that possibility. As a result, it is easy for the operator to take up the liquid storage bag 13. It is difficult for air to remain in the liquid storage bag 13. The present embodiment can reduce the possibility that it becomes difficult for the shaft portion 43 to move in the first direction.

As shown in FIG. 18, the plate member 972, which acts as a core member, can be inserted from the open portion 144 into the space that is formed between the sheets 13A and 13B at the position between the first connected portions 140 and 141, and the liquid storage bag 13 can be taken up. As a result, it is easy for the operator to take up the liquid storage bag 13 around the core member. In comparison to a case in which the first connected portions 140 and 141 are not provided, the length in the orthogonal direction of the space formed by the sheets 13A and 13B is shorter. Thus, a necessary length of the core member can be short in the orthogonal direction, in comparison to a case in which the length in the orthogonal direction of the space formed by the sheets 13A and 13B is long. Also, it becomes difficult for the plate member 972, which is the core member and which is inserted into the space from the open portion 144, to slip out of the space.

As shown in FIG. 5, the length L3 between the first connected portions 140 and 141 is shorter than the length L1 in the extending direction of the extension portion 134. In this case, in comparison to a case in which a length between the first connected portions 140 and 141 is equal to or longer than a length in the extending direction of the extension portion 134, the substantially rectangular space that is generated between the sheets 13A and 13B at the position between the first connected portions 140 and 141 has a shape that its length in the extending direction is longer than its length in the orthogonal direction. Thus, when the plate member 972, which is the core member, is inserted between the first connected portions 140 and 141 from the open portion 144, a distance can be secured to some extent between the rear edge portion 142 and the open portion 144. Accordingly, it is difficult for the plate member 972 to slip out of the space between the sheets 13A and 13B. As a result, it is easy for the operator to take up the liquid storage bag 13 around the core member.

By providing the curved area 146, it is easy for the operator to ascertain a position at which the taking up of the liquid storage bag 13 ends when taking up the liquid storage bag 13. Thus, it is easy for the operator to take up the liquid storage bag 13. When the liquid storage bag 13 is taken up by the shaft portion 43, the taking up of the liquid storage bag 13 can be stopped by the curved area 146. When the liquid storage bag 13 is taken up as far as a position of the insertion portion 76, it is possible that the liquid storage bag 13 may become pinched between the shaft portion 43 and the insertion portion 76 and the liquid storage bag 13 may be damaged. If the liquid storage bag 13 is damaged, ink leakage may be occurred. The present embodiment can reduce that possibility.

The corner portions 154 and 155 of the second connected portions 147 and 148 are provided, in the extending direction, between the end portion 762 in the extending direction of the insertion portion 76 and the end portion 156 in the extending direction of the curved area 146. In case that the corner portions 154 and 155 are provided further to the front than the end portion 762 of the insertion portion 76, ink remains between the curved area 146 which is the end position of taking up of the liquid storage portion 133 and the corner portions 154 and 155. In the present embodiment, the space between the end position of taking up and the corner portions 154 and 155 can be minimized at the time of ending of taking up of the liquid storage bag 13 on the side of the extending direction further to the insertion portion 76. Therefore, it is possible to reduce a remaining amount of ink in the liquid storage portion 133. A load is applied to the second connected portions 147 and 148 by the ink that is pressed to the plug 7 side.

The end edges 150 and 151 are inclined such that the further they separate from each other in the orthogonal direction, the further they are positioned in the extending direction. As a result, in comparison to a case in which the sides 150 and 151 simply extend in the orthogonal direction, it is easy for the ink to flow to the insertion portion 76 along the sides 150 and 151 because the end edges 150 and 151 guide ink. Thus, it is possible to reduce the amount of ink remaining in the liquid storage portion 133.

When the liquid storage body 31 is manufactured, a manufacturer injects ink into the liquid storage portion 133 via the plug 7. At that time, the end edges 150 and 151 are inclined and thus, air that is inside the liquid storage portion 133 moves along the end edges 150 and 151 toward the insertion portion 76 and emerges to the outside by passing through the plug 7. As a result, it is difficult for air to remain inside the liquid storage portion 133.

In the present embodiment, in concert with the operator performing the operation of sliding the second case 60 with respect to the first case 33, the shaft portion 43 is caused to move in the second direction while the pressing wall portions 67 and 68 resist the urging force of the elastic member 45 (refer to FIG. 15B). As a result, the elastic member 45 that is taken up on the shaft portion 43 is extended. The operator can house the liquid storage body 31 inside the case 32 in the state in which the elastic member 45 is extended (refer to FIG. 15C). Thus, in comparison to a case in which the elastic member 45 is extended manually after the second case 60 has been moved with respect to the first case 33 and the liquid storage body 31 is mounted, it is possible to easily mount the liquid storage body 31 in the case 32.

The present disclosure is not limited to the above-described embodiment, and various modifications are possible to the above-described embodiment. For example, the liquid storage bag 13 is formed by thermally bonding the two sheets 13A and 13B to each other. However, the sheets 13A and 13B may be bonded by a method other than thermal bonding. For example, the liquid storage bag 13 may be formed by bonding the two sheets 13A and 13B to each other using an adhesive. The liquid storage bag 13 is formed by the two sheets 13A and 13B, but it is sufficient that the sheet that forms the liquid storage bag 13 has two layers in order to form a closed space in which liquid can be stored. Therefore, the present disclosure is not limited to the configuration that the liquid storage bag 13 is formed of two sheets. For example, the liquid storage bag 13 may be formed by folding over a single flexible sheet to form two layers and bonding one end in the orthogonal direction.

In the present embodiment, the edge portions 135 and 136 extend as far as the end portion in the extending direction of the extension portion 134. However, it is sufficient that the edge portions 135 and 136 be arranged at the end portions in the orthogonal direction of the liquid storage portion 133. In other words, the end portions in the orthogonal direction of the extension portion 134 need not necessarily be bonded. The open portions 143, 144 and 145 need not necessarily be provided and the portions corresponding to the open portions 143, 144 and 145 may be bonded. The end edges 150 and 151 may extend in parallel to the orthogonal direction. The positions of the corner portions 154 and 155 are not particularly limited and may be, for example, further to the front than the end portion 762 of the insertion portion 76. The curved area 146 need not necessarily be provided.

The length L3 between the first connected portions 140 and 141 may be equal to or longer than the length L1 in the extending direction of the extension portion 134. The first connected portions 140 and 141 are not necessarily limited to the two connected portions and three or more connected portions or a single connected portion may be provided. The first connected portions 140 and 141 need not necessarily be provided. The tapered portions 137 and 138 need not necessarily be provided.

A friction coefficient of a surface on the outside of the extension portion 134 may be larger than a friction coefficient of a surface on the outside of the liquid storage portion 133. For example, on a side that the electric board 98 is to be mounted to the holder 90 of the liquid storage body 31, the friction coefficient of the surface of the extension portion 134 may be larger than the friction coefficient of the surface of the liquid storage portion 133. In this case, for example, the surface on the outside of the extension portion 134 may be formed to be uneven. Further of alternatively, for example, a member that has a larger friction coefficient than the surface on the outside of the liquid storage portion 133, such as a synthetic resin sheet etc., may be adhered to the surface on the outside of the extension portion 134. In this case, in comparison to a case in which the friction coefficient of the surface on the outside of the extension portion 134 is equal to or less than the friction coefficient of the surface on the outside of the liquid storage portion 133, when the operator takes up the liquid storage bag 13 while causing the circular columnar member 971 or the shaft portion 43 of the cartridge 3 that is used for winding to come into contact with the surface on the outside of the extension portion 134, it is difficult for the extension portion 134 to slip with respect to the circular columnar member 971 or the shaft portion 43. Further, when the operator manually winds the liquid storage bag 13 without using the core member, such as the circular columnar member 971, it is difficult for the extension portion 134 to slip at the start of the winding. Thus, it is easy for the operator or the shaft portion 43 to take up the liquid storage bag 13.

As shown by dashed lines in FIG. 5, adhesive members 891 and 892 may be provided on the surface on the outside of the extension portion 134. The adhesive members 891 and 892 may be a bond, for example, or may be a double-sided adhesive tape. One or more adhesive members can be provided. In this case, in comparison to a case in which the adhesive members 891 and 892 are not provided, when the operator takes up the liquid storage bag 13 while causing the circular columnar portion 971 or the shaft portion 43 of the cartridge 3 that is used for winding to come into contact with the surface on the outside of the extension portion 134, it is difficult for the extension portion 134 to slip with respect to the circular columnar member 971 or the shaft portion 43. Thus, it is easy for the operator or the shaft portion 43 to take up the liquid storage bag 13.

Figure 19:
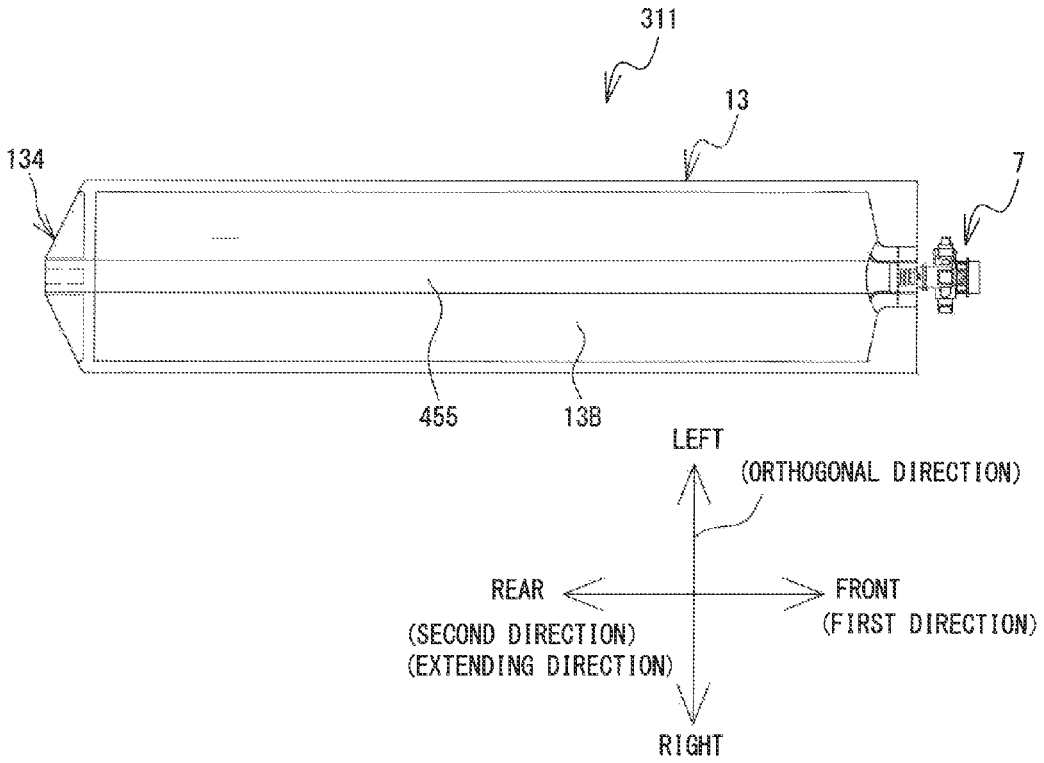
FIG. 19 is a bottom view of a liquid storage body of a modified example.

The structure in which the elastic member 45 is provided inside the case 32 is not essential. For example, as shown in FIG. 19, an elastic member 455 may be adhered to a center portion in the orthogonal direction of the sheet 13B on the bottom surface side of the liquid storage bag 13. The elastic member 455 extends in the second direction (the extending direction) from the second direction side of the plug 7 that is provided on the end portion on the first direction side. The end portion on the second direction side of the elastic member 455 is positioned in the extension portion 134. When a liquid storage body 311 is used, the mounting portion 336 (refer to FIG. 10) and the elastic member 45 (refer to FIG. 8) need not necessarily be provided in the first case 33. By placing the liquid storage body 311 in the case 32 that is not provided with the elastic member 45, and winding the end portion on the second direction side of the elastic member 455 around the shaft portion 43 along with the extension portion 134, it is possible to take up the liquid storage bag 13 in a similar manner to the cases shown in FIG. 15A to FIG. 15D and FIG. 16A to FIG. 16D and then to push liquid in the liquid storage portion 133 out to the plug 7.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A liquid storage body comprising:

a hollow plug member having a hollow portion at an inside thereof, the hollow portion being extended in an axial direction; and a bag connected to the hollow plug member at a first end portion of the bag and extending in an extending direction being a direction extending from the first end portion to a second end portion of the bag along the axial direction, the bag including a first flexible sheet and a second flexible sheet facing each other in a facing direction orthogonal to the extending direction and jointed to each other, the bag including:

a side edge joint portion formed to join the first flexible sheet and the second flexible sheet on an end of the bag in a width direction orthogonal to both the facing direction and the extending direction;

a rear joint portion extending in the width direction and formed to join the first flexible sheet and the second flexible sheet on the second end portion of the bag;

a liquid storage portion formed between the rear joint portion and the first end portion of the bag in the extending direction, the liquid storage portion having an enclosed space in which liquid can be stored and connected to the hollow plug member at the first end portion;

an extension portion partitioned from the liquid storage portion in the extending direction by the rear joint portion liquid-tightly sealing the liquid storage portion, the extension portion extending from the rear joint portion in the extending direction being opposite to a direction from the rear joint portion toward the liquid storage portion, the extension portion having a length in the extending direction longer than a length in the width direction of the side edge joint portion; and the extension portion being formed in a tapered shape having a width in the width direction becoming narrower as advancing toward the extending direction, the tapered shape having first outer edge linearly extending from one end of the bag in the width direction to a tip end, in the extending direction, of the extension portion and a second outer edge linearly extending from another end of the bag in the width direction to the tip end of the extension portion, the first outer edge and the second outer edge approaching each other as advancing toward the tip end of the extension portion.

2. The liquid storage body according to claim 1, wherein the extension portion includes an open portion formed by a gap between the first flexible sheet and the second flexible sheet unjointed with each other and opening from the rear joint portion toward end edges in the extending direction of the first and second flexible sheets.

3. The liquid storage body according to claim 1, wherein the extension portion includes an extending joint portion formed to join the first flexible sheet and the second flexible sheet on the second end portion of the bag and extending from the rear joint portion in the extending direction.

4. The liquid storage body according to claim 3, wherein the extension portion includes a plurality of the extending joint portions, and an interval in the width direction between adjacent two of the extending joint portions is smaller than a length in the extending direction of the extension portion.

5. The liquid storage body according to claim 3, wherein at least a portion of the tapered shape is located on an outer side of the extending joint portion, the outer side being a side in the width direction at which the side edge joint portion is located.

6. The liquid storage body according to claim 5, wherein a first edge of the extending joint portion coincide with the tip end of the extension portion, the first edge being an edge provided at the outer side.

7. The liquid storage body according to claim 3, wherein the extension portion includes a plurality of the extending joint portions, an open portion is provided between adjacent two of the extending joint portions, the open portion is formed by a gap between the first flexible sheet and the second flexible sheet unjointed with each other and opening from the rear joint portion toward end edges in the extending direction of the first and second flexible sheets.

8. The liquid storage body according to claim 1, wherein the hollow plug member has an insertion portion provided on an end portion in the extending direction of the hollow plug member between the first flexible sheet and the second flexible sheet, the hollow plug member being inserted to the inside of the liquid storage portion, and the bag has a curved area provided on the first end portion, the curved area being an area curved along the insertion portion in a direction in which the first flexible sheet and the second flexible sheet separate from each other, the curved area extending further in the extending direction than the insertion portion.

9. The liquid storage body according to claim 8, wherein the bag has two front joint portions formed to join the first flexible sheet and the second flexible sheet on the first end portion, each of the two front joint portions being located on each side in the width direction of the insertion portion, and positions, in the extending direction, of corner portions of the front joint portions, which are positioned on inside in the width direction and to the extending direction side of the bag, are between an end portion in the extending direction of the insertion portion and an end portion in the extending direction of the curved area.

10. The liquid storage body according to claim 9, wherein end edges on extending direction side of the front joint portions are inclined such that the further the end edges apart from each other in the width direction, the further the end edges are positioned in the extending direction.

11. The liquid storage body according to claim 1, wherein a friction coefficient of an outer surface of the extension portion is larger than a friction coefficient of an outer surface of the liquid storage portion, wherein the outer surface of the extension portion and the outer surface of the liquid storage portion are formed by an outer surface of the first flexible sheet, wherein the outer surface of the first flexible sheet is provided on a flip side of an inner surface of the first flexible sheet, and wherein the inner surface of the first flexible sheet faces to the second flexible sheet.

12. The liquid storage body according to claim 1, wherein an adhesive member is provided on an outer surface of the extension portion, wherein the outer surface of the extension portion is formed by an outer surface of the first flexible sheet, wherein the outer surface of the first flexible sheet is provided on a flip side of an inner surface of the first flexible sheet, and wherein the inner surface of the first flexible sheet faces to the second flexible sheet.

* * * * *